US006301946B1

(12) United States Patent
Kukizaki et al.

(10) Patent No.: US 6,301,946 B1
(45) Date of Patent: Oct. 16, 2001

(54) STRIP COILING METHOD

(75) Inventors: Taichi Kukizaki; Yasuo Ichii; Toshio Imazeki; Satoshi Shibuya; Kiyoshi Ueda; Itaru Hishinuma; Hideyuki Nikaidoh, all of Chiba (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/673,954

(22) PCT Filed: Sep. 22, 1999

(86) PCT No.: PCT/JP99/05198

§ 371 Date: Dec. 4, 2000

§ 102(e) Date: Dec. 4, 2000

(87) PCT Pub. No.: WO00/58039

PCT Pub. Date: Oct. 5, 2000

(30) Foreign Application Priority Data

| | | |
|---|---|---|
| Mar. 27, 1998 | (JP) | 10-081901 |
| Jun. 8, 1998 | (JP) | 10-159414 |
| Jan. 19, 1999 | (JP) | 10-007353 |
| Mar. 25, 1999 | (JP) | 11-082074 |

(51) Int. Cl.[7] ..... B21C 47/00
(52) U.S. Cl. ..... 72/148; 72/203; 72/10.2
(58) Field of Search ..... 72/10.2, 10.3, 72/132, 146, 148, 203, 365.2

(56) References Cited

U.S. PATENT DOCUMENTS 5,857,370 * 1/1999 Grenz et al. ..... 72/203 R

FOREIGN PATENT DOCUMENTS

| | | | | |
|---|---|---|---|---|
| 893420 | * | 1/1981 | (JP) | 72/203 |
| 58-163524 | * | 9/1983 | (JP) | 72/148 |
| 60-148626 | * | 8/1985 | (JP) | 72/148 |
| 60-240335 | * | 11/1985 | (JP) | 72/148 |
| 2-21329 | * | 5/1990 | (JP) | 72/148 |
| 2-160109 | | 6/1990 | (JP) . | |
| 4-135015 | | 5/1992 | (JP) . | |
| 5-154550 | | 6/1993 | (JP) . | |
| 6-182438 | | 7/1994 | (JP) . | |
| 7-75825 | | 3/1995 | (JP) . | |
| 7-124623 | | 5/1995 | (JP) . | |
| 7-236916 | | 9/1995 | (JP) . | |
| 8-90058 | | 4/1996 | (JP) . | |
| 9-276931 | | 10/1997 | (JP) . | |
| 11-197741 | | 7/1999 | (JP) . | |
| 11-277133 | | 10/1999 | (JP) . | |
| 11-347619 | | 12/1999 | (JP) . | |

* cited by examiner

*Primary Examiner*—Ed Tolan
(74) *Attorney, Agent, or Firm*—Oliff & Berridge, PLC

(57) ABSTRACT

In order to prevent a preceding strip from being oversupplied on a delivery side of a coiling pinch rolls and to prevent a leading end of the following material from being over supplied on an entrance side of the coiling pinch rolls, to provide a strip coiling method in which a strip sent from a rolling mill is cut to a predetermined length by a strip shear (102), and a cut strip is coiled by a mandrel (107) of a coiler (104) via a coiling pinch rolls (105) disposed on a delivery side of a strip shear (102), characterized in that after a tail end of the strip coiled by the mandrel (107) via the coiling pinch rolls (105) is cut by the strip shear (102), a circumferential speed of the coiling pinch rolls (105) is higher than a transfer speed of the following material immediately after the cutting operation and lower than a coiling speed of the strip coiled by the mandrel (107).

11 Claims, 16 Drawing Sheets

STATE AT TIME $t_0$

STATE AT TIME $t_3$

STATE AT TIME $t_7$

STRIP COILING METHOD

This application is a 371 of PCT/JT99/05198 filed Sep. 22, 1999.

TECHNICAL FIELD

The present invention relates to a strip coiling method in which a strip sent from a hot rolling mill is cut to a predetermined length by a strip shear and the cut strip is coiled by a mandrel of a coiler via coiling pinch rolls disposed on the delivery side of a strip shear.

BACKGROUND ART

FIG. 16 shows a general arrangement of a general continuous hot rolling line. Conventionally, changeover of coilers has been effected as described below when a strip cut to a predetermined length by a strip shear is coiled by the preceding material coiler and the following material coiler alternately. As an example, a case where coilers are changed over from the preceding material coiler a to the following material coiler b will be explained. A strip d sent from a finishing mill c is cut to a predetermined length by a strip shear e disposed on the downstream side of the finishing mill c to divide the strip d into the preceding strip $d_1$ and the following strip $d_2$. Then, the preceding strip $d_1$ and the following strip $d_2$ are coiled by the preceding material coiler a and the following material coiler b, respectively.

While the preceding strip $d_1$ is coiled by the preceding material coiler a, a lower pinch roll g of a coiling pinch roll f disposed on the delivery side of the strip shear e is moved to the upstream side. Thereby, the offset angle of the coiling pinch roll f is changed to change the transfer direction of the strip from the preceding material coiler a to the following material coiler b. Immediately after the preceding strip $d_1$ has gone through the coiling pinch roll f, the following strip $d_2$ is introduced to the following material coiler b to coil the following strip $d_2$ by using the following material coiler b. At this time, a triangular gate j prevents the following strip $d_2$ from going to the side of the preceding material coiler a.

In recent years, as coiling equipment for continuous hot rolling, a Carrousel reel type coiler has been used.

FIG. 20 schematically shows an example of a continuous hot rolling line in which a Carrousel reel type coiler is used.

The Carrousel reel type coiler has a first and second mandrels 1 and 2. The first and second mandrels 1 and 2 are revolvably disposed at an interval in the circumferential direction on a revolution path 3 so that when one mandrel is located at a coiling start position, the other mandrel is located at a coiling finish position. For example, when the first mandrel 1 is located at the coiling start position, the preceding strip $S_1$ sent from a finishing mill 4 is coiled by a predetermined amount by the first mandrel 1, and then the first mandrel 1 is revolved to the coiling finish position while coiling the preceding strip $S_1$. In this state, the tail end of the preceding strip $S_1$ is cut by a strip shear 5, and the leading end of the following strip $S_2$ is coiled by the second mandrel 2 located at the coiling start position. After the coiling of the strip $S_1$ is finished at the coiling finish position, the coil of the coiled preceding strip $S_1$ is delivered from the mandrel 1, and the mandrel 1 waits until the leading end of a strip following the following strip $S_2$ is coiled around the mandrel 1.

Above and below an upstream pass line $P_1$ directed toward the mandrel at the coiling start position (the first mandrel 1 in the figure), upstream sheet-running guides 6 to 13 for guiding the leading end of the strip S toward the upstream mandrel are disposed. Above and below a downstream pass line $P_2$ that branches off the upstream pass line $P_1$ and is directed toward the mandrel at the coiling finish position (the second mandrel 2 in the figure), downstream sheet-running guides 13 to 15 and a guide roller 20 for guiding the strip S coiled by the mandrel at the coiling finish position are disposed. The sheet-running guide 13 is disposed at a position where the downstream pass line $P_2$ branches off the upstream pass line $P_1$ so as to be used as both an upper guide for the upstream pass line $P_1$ and a lower guide for the downstream pass line $P_2$.

In FIG. 20, reference numeral 16 denotes pinch rolls disposed on the pass line $P_1$ between the finishing mill 4 and the strip shear 5, 17 denotes coiling pinch rolls disposed on the pass line $P_1$ on the delivery side of the strip shear 5, 18 denotes upstream wrapper rolls disposed movably so as to come close to and go apart from the outer peripheral surface of the mandrel at the coiling start position, and 19 denotes downstream wrapper rolls disposed movably so as to come close to and go apart from the outer peripheral surface of the mandrel at the coiling finish position. The upstream and downstream wrapper rolls 18 and 19 and the upper guide 14 of the downstream sheet-running guide is movable so as to be separated from the revolution path 3 to allow the revolution of the first and second mandrels 1 and 2 when the mandrels 1 and 2 revolves on the revolution path 3.

In the conventional strip coiling method on the above-described general hot rolling line, however, when the strip is cut by the strip shear e, a tension given to the strip by the f inishing mill c and the preceding material coiler a is released, so that the tail end of the preceding strip is undesirably oversupplied on the delivery side of the coiling pinch roll f as shown in FIG. 17. In the worst case, there arises a problem in that the tail end of the preceding strip is caught by the triangular gate j, resulting in damage to the sheet. Further, there arises a problem in that after the tail end of the preceding strip $S_1$ goes through the coiling pinch roll f, the circumferential speed of the coiling pinch roll f temporarily becomes lower than the transf er speed of the following strip $S_2$, so that the leading end of the following strip $S_2$ is oversupplied on the entrance side of the coiling pinch roll f.

On the other hand, even in the conventional strip coiling method on the hot rolling line on which the Carrousel reel type coiler is provided, if the preceding strip $S_1$ is cut by the strip shear 5 while being coiled by the mandrel at the coiling finish position (the second mandrel 2), a tension given to the strip by the finishing mill 4 and the downstream mandrel is released, so that the preceding strip $S_1$ is undesirably oversupplied on the delivery side of the coiling pinch rolls 17 disposed on the delivery side of the strip shear as shown in FIG. 21. In the worst case, there arises a problem in that the preceding strip $S_1$ is caught by the tip end of the downstream sheet-running guide 13 located at a position where the downstream pass line $P_2$ branches off the upstream pass line $P_1$, resulting in damage to the sheet. Further, there arises a problem in that after the tail end of the preceding strip $S_1$ goes through the coiling pinch rolls 17, the circumferential speed of the coiling pinch rolls 17 temporarily becomes lower than the transfer speed of the following strip $S_2$, so that the leading end of the following strip $S_2$ is oversupplied on the entrance side of the coiling pinch rolls 17.

The present invention has been achieved to solve the above problems, and accordingly an object thereof is to provide a strip coiling method in which after the tail end of a strip coiled by a mandrel is cut by a strip shear, the strip can be prevented from being oversupplied on the delivery side of coiling pinch rolls disposed on the delivery side of the strip shear, and the leading end of the following strip can be prevented from being oversupplied on the entrance side of the coiling pinch rolls.

DISCLOSURE OF THE INVENTION

To attain the above object, the present invention provides a strip coiling method in which a strip sent from a rolling mill is cut to a predetermined length by a strip shear, and the cut strip is coiled by a mandrel of a coiler via coiling pinch rolls disposed on the delivery side of the strip shear, characterized in that after the tail end of the strip coiled by the mandrel via the coiling pinch rolls is cut by the strip shear, the circumferential speed of the coiling pinch rolls is higher than the transfer speed of the following material immediately after the cutting operation and lower than the coiling speed of the strip coiled by the mandrel.

In the present invention, a force pulling the strip between the strip shear and the coiling pinch rolls toward the downstream side is applied to the strip having been cut, and a force pulling the strip between the coiling pinch rolls and the mandrel toward the downstream side is also applied to the strip. Therefore, the preceding strip can be prevented from being oversupplied on the delivery side of the coiling pinch rolls. Moreover, since the circumferential speed of the coiling pinch rolls is higher than the transfer speed of the following material immediately after the cutting operation, the leading end of the following material can be prevented from being oversupplied on the entrance side of the coiling pinch rolls.

In this case, the aforementioned mandrel is a mandrel of a Carrousel reel type coiler, and the relationship between a preset coiling speed $V_m$ of the mandrel after the tail end of the strip coiled by the mandrel via the coiling pinch rolls, the target speed $V_p$ of the coiling pinch rolls at the time of the cutting operation, and the sheet speed $V_s$ of the following material immediately after the cutting operation is set so that $V_m>V_p>V_s$. Thereby, the preceding strip can be prevented from being caught by the tip end of a sheet-running guide located at a position where a pass line directed to the mandrel at the coiling start position branches off a pass line directed to the mandrel at the coiling finish position.

Also, in a strip coiling method in which a strip sent from a rolling mill is cut to a predetermined length by a strip shear, and the cut strip is coiled alternately by a mandrel of an upstream coiler and a mandrel of a downstream coiler via first coiling pinch rolls disposed on the delivery side of the strip shear, the relationship between the target speed $V_{p1}$ of the second coiling pinch rolls after the tail end of the strip coiled by a downstream mandrel via second coiling pinch rolls disposed on the entrance side of the downstream mandrel is cut by the strip shear, the target speed $V_{p2}$ of the first coiling pinch rolls, the target sheet speed $V_s$ of the following material immediately after the cutting operation, and the preset coiling speed $V_m$ of the downstream mandrel is set so that $V_m>V_{p1}>V_{p2}>V_s$. Thereby, damage to the strip caused by the tail end of the preceding strip being caught by a triangular gate can be prevented.

In this case, after the lower pinch roll of the first coiling pinch rolls is offset and before the tail end of the strip coiled by the downstream mandrel via the second pinch rolls is cut, the strip is pressed by the upper pinch roll of the first coiling pinch rolls in a state in which the speed of the lower pinch roll is made lower than the target sheet speed $V_s$ , of the following material until the actual torque value of the lower pinch roll becomes the preset value, and the pressing force at this time is made the preset pressing force of the offset upper pinch roll applied to the strip, by which the tail end of the strip coiled by the downstream mandrel can be held properly by the first coiling pinch rolls.

Also, before the strip cut by the strip shear is continuously coiled by the mandrel via the coiling pinch rolls disposed on the delivery side of the strip shear, the pressing force of the coiling pinch rolls is set at a value not lower than a value P determined by $P=2F(\Delta u/\Delta Ax)+4(M_B/\Delta x)\ \{(l_a/R_L)+(l_b/R_U)\}$. Thereby, the pressing force of the upper pinch roll can be set at the optimum value. Therefore, the breakage of tail end of a thin strip, improper introduction of a thick strip to the coiler, or the like can be prevented.

In this case, after the pressing force is set, by keeping a gap of the coiling pinch rolls for the time from when the preceding strip comes off from the pinch rolls to when the following strip is bitten by the pinch rolls, the defective biting of the following strip by the coiling pinch rolls and other troubles can be prevented.

Further, before the strip coiling operation performed by the mandrel is finished, the strip coiling control carried out by the mandrel is changed over from torque control to rotational speed control, and thereafter a pressing roll is pressed on the strip to be coiled into a coil shape to stop the rotation of the mandrel. Thereby, the decrease in speed of coil caused by the contact of the pressing roll can be prevented, so that the occurrence of defective coiling such as loosened coil outer and telescoping can be avoided, and the rotation of coil can be stopped in a short time because the pressing roll has a braking force when the rotation of coil is stopped after the strip coiling operation is finished.

Further, before the strip coiling operation performed by the mandrel is finished, the torque control of strip is carried out by the mandrel to increase the tension of strip, and thereafter the pressing roll is pressed on the strip to be coiled into a coil shape to stop the rotation of the mandrel. Thereby, the decrease in speed of coil caused by the contact of the pressing roll can be prevented, so that the occurrence of defective coiling such as loosened coil outer and telescoping can be avoided, and the rotation of coil can be stopped in a short time because the pressing roll has a braking force when the rotation of coil is stopped after the strip coiling operation is finished.

Further, a deceleration-side torque limit of a driving unit for the coiling pinch rolls is set so that the circumferential speed of the coiling pinch rolls is higher than the transfer speed of the following material when the leading end of the following material is bitten by the coiling pinch rolls disposed on the delivery side of the strip shear after the strip is cut by the strip shear. Thereby, even in the case of a strip having a great sheet thickness and high bending rigidity, the following material can be prevented from being oversupplied on the entrance side of the coiling pinch rolls.

BRIEF DESCRIPTION THE DRAWINGS

Figure 13:
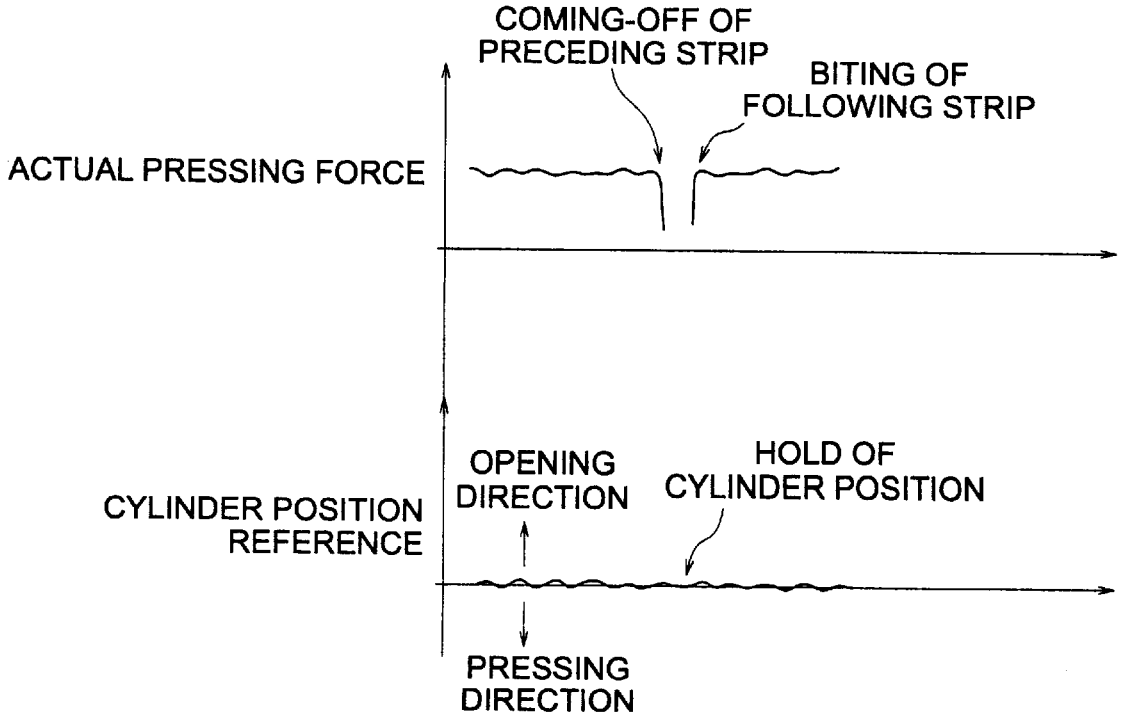
Figure 14:
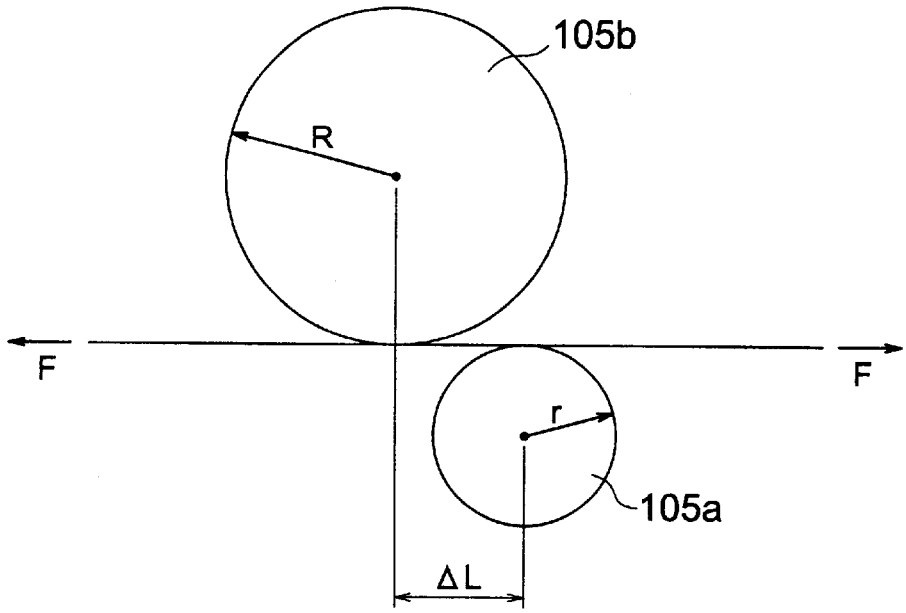
Figure 15:
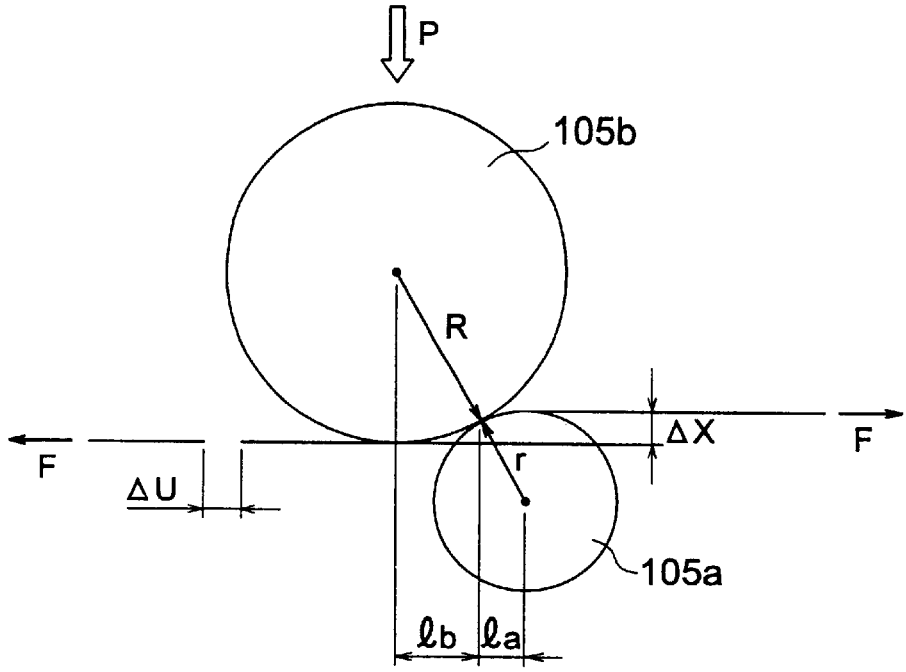
Figure 16:
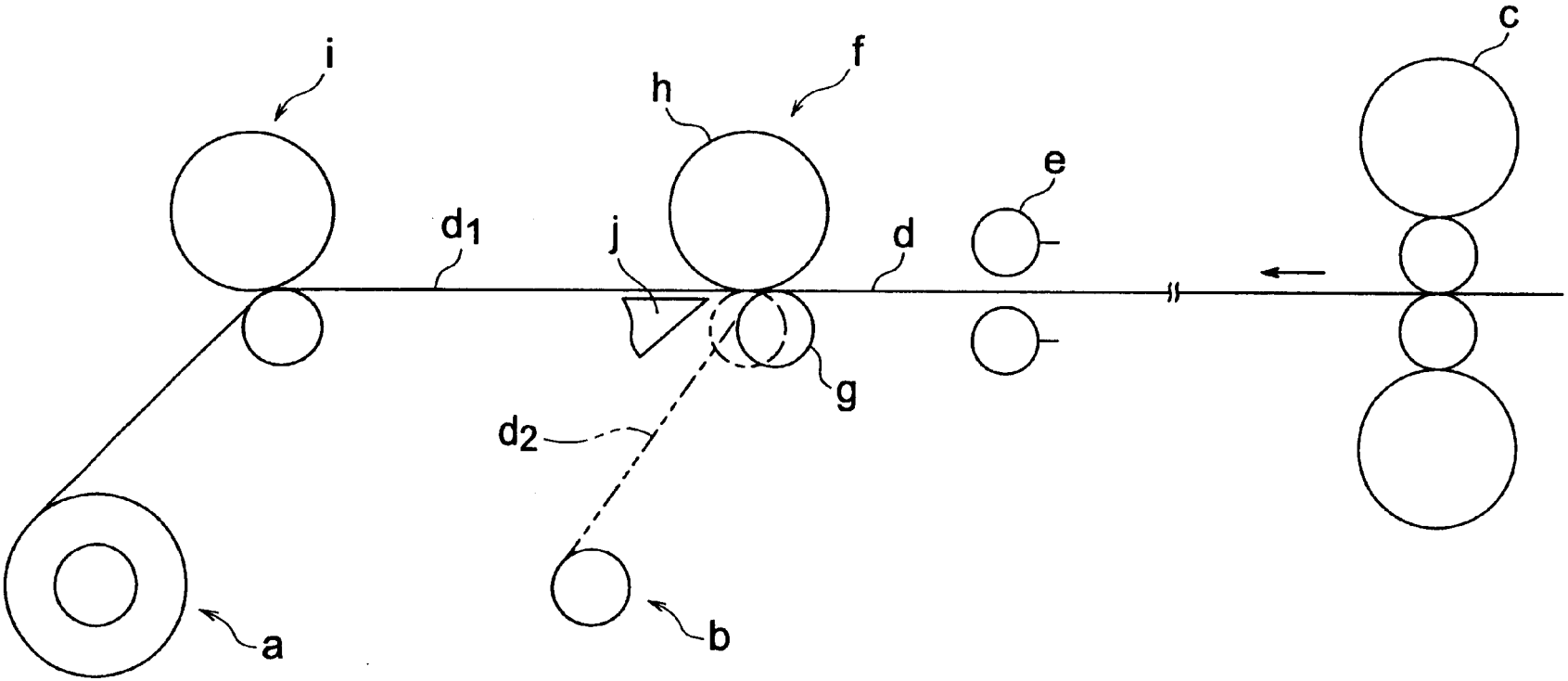
Figure 17:
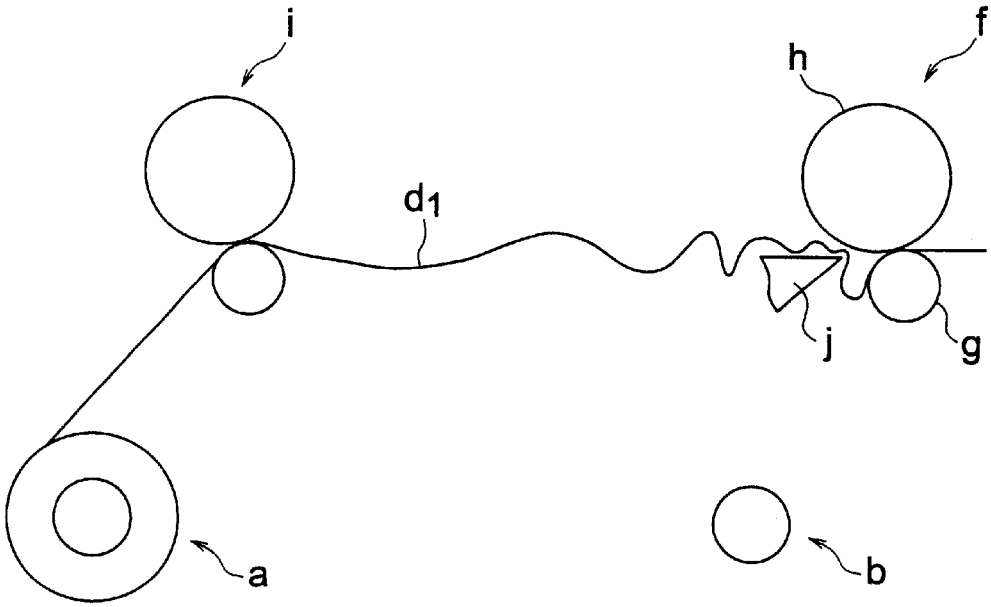
Figure 18:
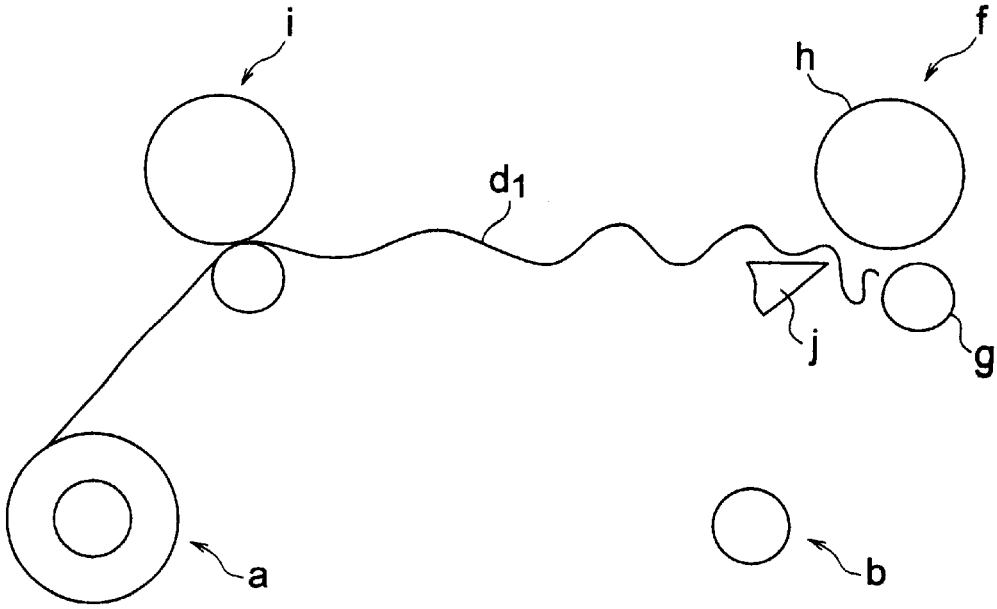
Figure 19:
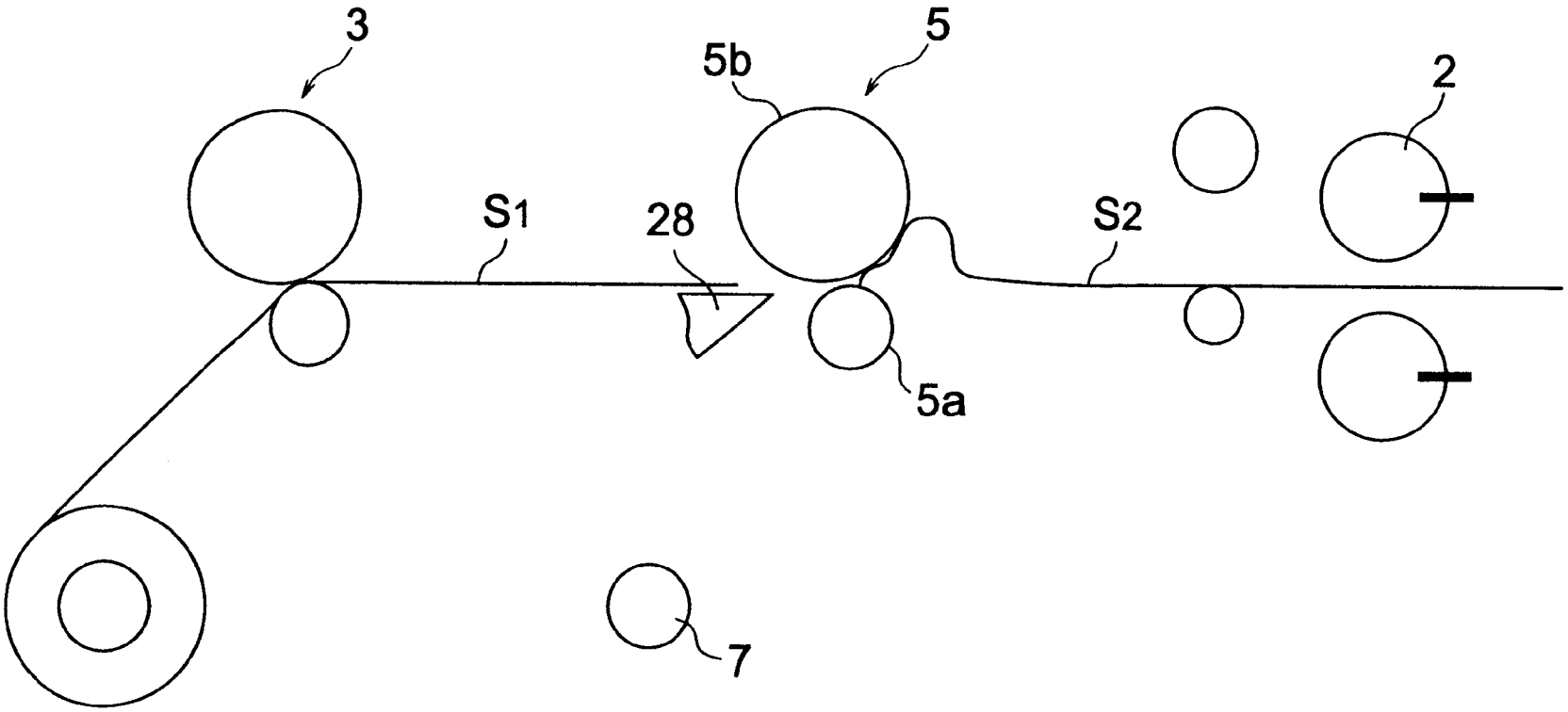
Figure 20:
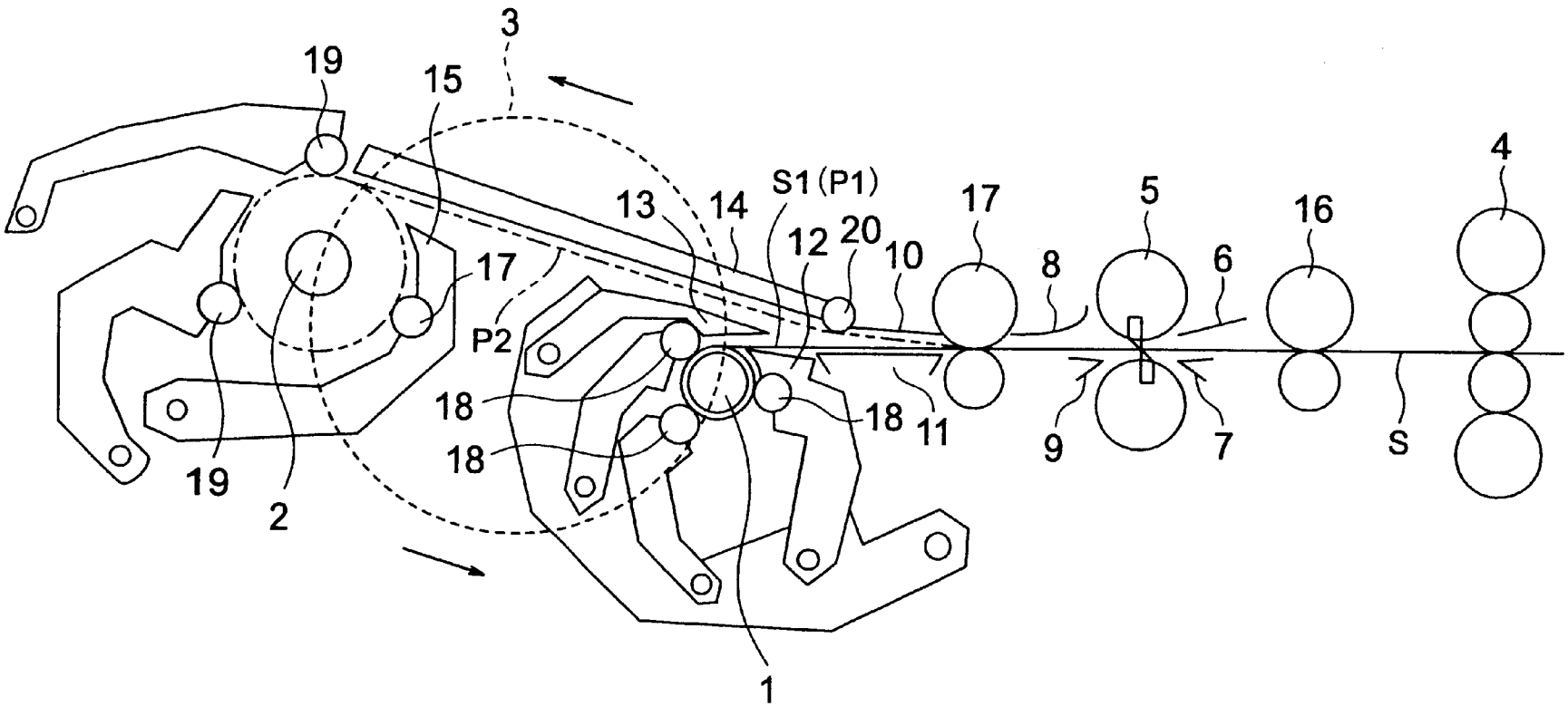

FIG. 13 a time chart of the pressing force on a strip caused by the upper pinch roll of the coiling pinch rolls and a cylinder position on reference;

FIG. 14 is a side view of the coiling pinch rolls at the time of offset;

FIG. 15 is a side view showing a case where a strip is pressed down by the upper pinch roll of the coiling pinch rolls;

FIG. 16 is a general schematic view of a general continuous hot rolling line;

FIG. 17 is an explanatory view for illustrating oversupply of the strip tail end at the delivery side of the coiling pinch rolls;

FIG. 18 is an explanatory view for illustrating a problem arising when the pressing force on a strip caused by the upper pinch roll of the oiling pinch rolls is weak;

FIG. 19 is an explanatory view for illustrating oversupply of the following strip leading end on the entrance side of the coil pinch rolls;

FIG. 20 is a view schematically showing a Carrousel reel type coiler; and

Figure 21:
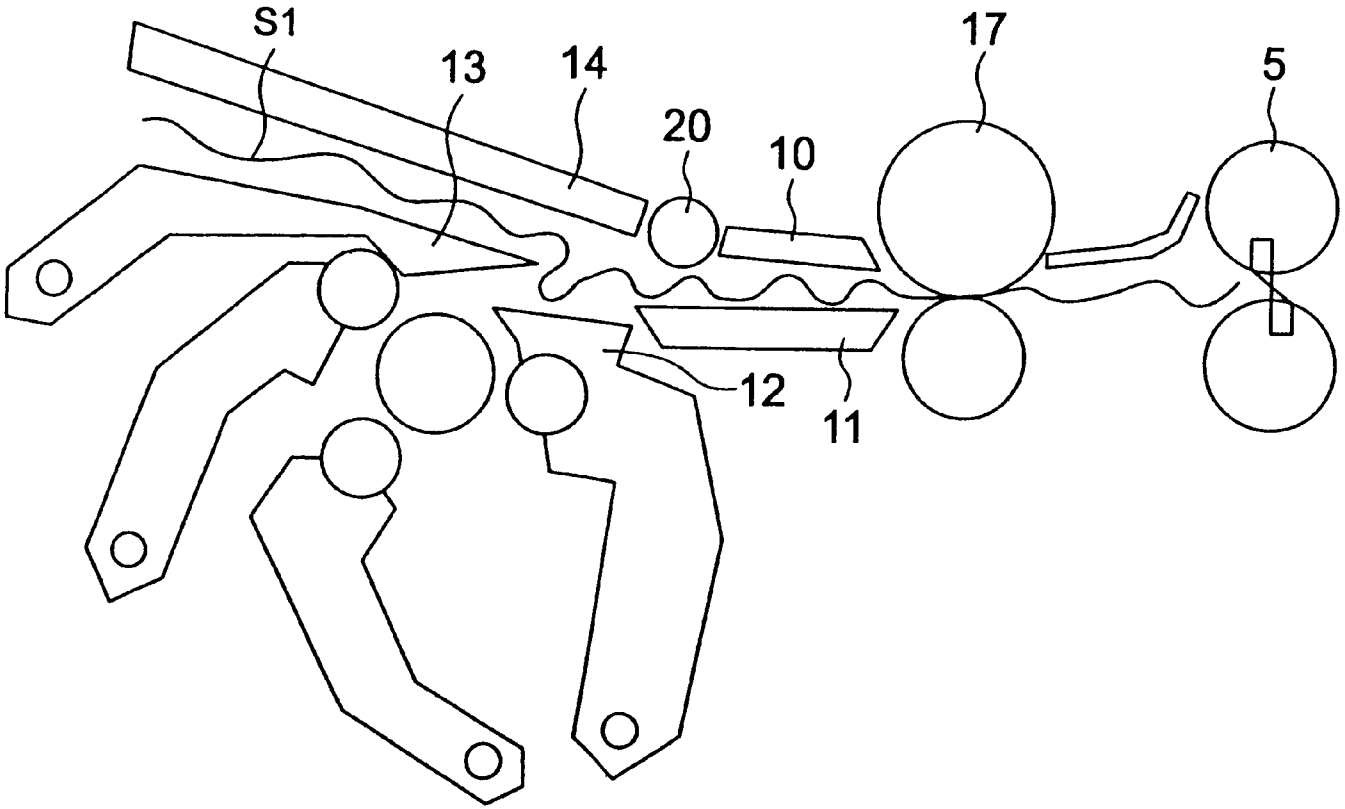

FIG. 21 is an explanatory view for illustrating oversupply of the strip tail end on the delivery side of the coiling pinch rolls.

BEST MODE FOR CARRYING OUT THE INVENTION

Embodiments of the present invention will now be described with reference to the accompanying drawings.

First, a strip coiling method on a general hot rolling line, which is a first embodiment of the present invention, will be explained with reference to FIGS. 1 to 3.

Figure 1:
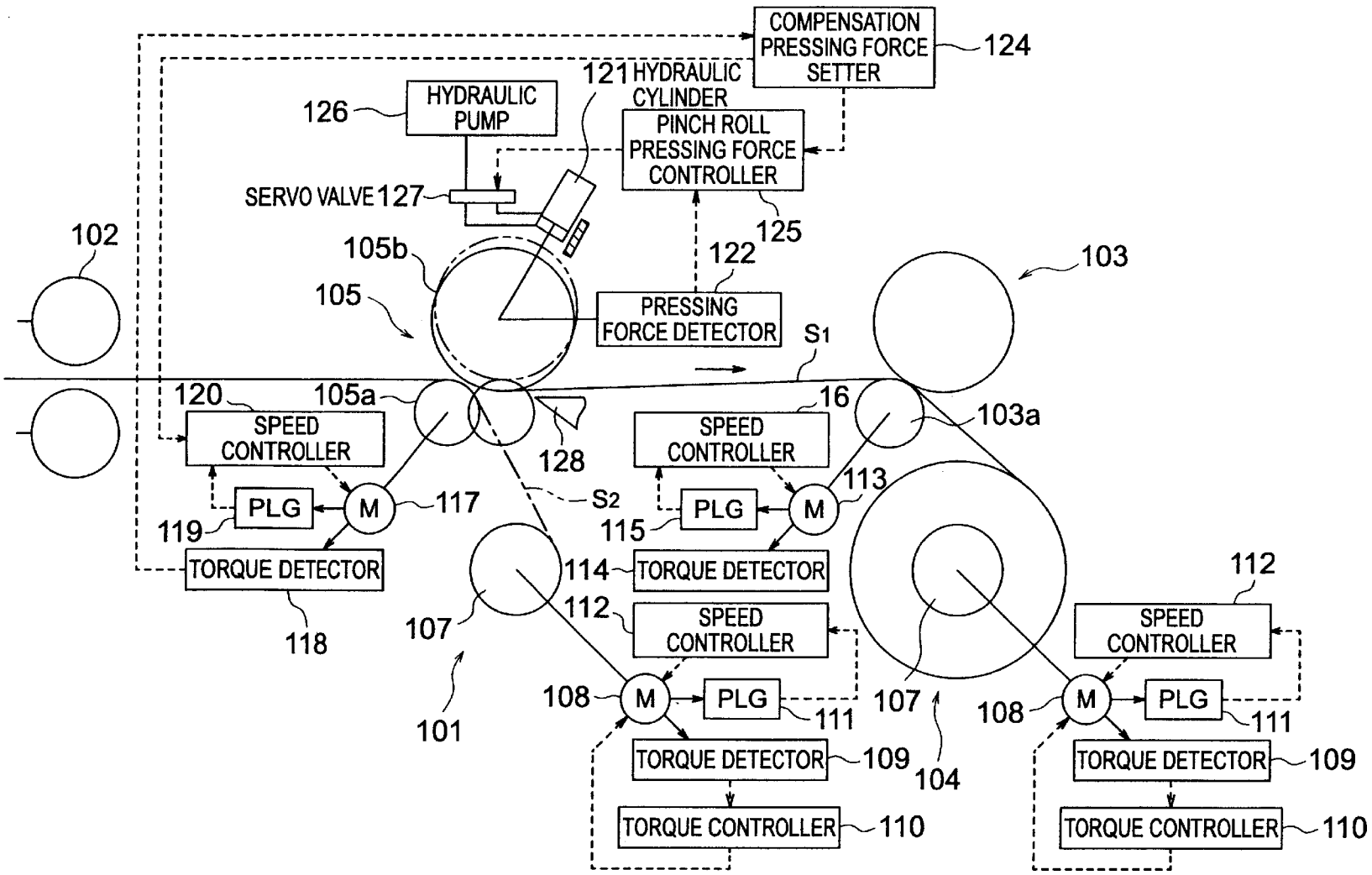
FIG. 1 is an explanatory view for illustrating a strip coiling method in accordance with a first embodiment of the present invention.

FIG. 1 schematically shows a portion of a continuous hot rolling line on the downstream side of a strip shear. In this embodiment, a case where a strip sent from a finishing mill (not shown) is cut to a predetermined length by using a strip shear 102, and the preceding strip $S_1$ is coiled by a mandrel 107 of a downstream oiler 104 via downstream coiling pinch rolls (second coiling pinch rolls) 103, whereas the following strip $S_2$ is coiled by a mandrel 107 of an upstream coiler 101 via upstream coiling pinch rolls (first coiling pinch rolls) 105 disposed on the delivery side of the strip shear 102 is explained by way of example.

Both of the downstream coiler 104 and the upstream coiler 101 are provided with a torque detector 109 for detecting a torque of a motor 108 for driving the mandrel 107, a torque controller 110 for keeping the tension of a strip constant by feedback controlling the motor 108 so that the detected torque value obtained by the torque detector 109 coincides with the target torque value, a pilot generator (PLG) 111 for detecting the rotational state of the motor 108, and a speed controller 112 for feedback controlling the motor 108 so that the speed detection value obtained by the pilot generator 111 coincides with the target speed, as means for pulling the strip coiled around the mandrel 107 with a predetermined coiling tension.

Also, the downstream coiling pinch rolls 103 are provided with a torque detector 114 for detecting a torque of a motor 113 for a lower pinch roll 103*a,* a pilot generator (PLG) 115 for detecting the rotational state of the motor 113, and a speed controller 116 for feedback controlling the motor 113 so that the speed detection value obtained by the pilot generator 115 coincides with the target speed $V_{p1}$ .

Further, the upstream coiling pinch rolls 105 are also provided with a torque detector 118 for detecting a torque of a motor 117 for a lower pinch roll 105*a,* a pilot generator (PLG) 119 for detecting the rotational state of the motor 117, and a speed controller 120 for feedback controlling the motor 117 so that the speed detection value obtained by the pilot generator 119 coincides with the target value $V_{p2}$. The lower pinch roll 105*a* can be moved to the upstream side along a pass line when the offset angle is changed to effect changeover from the downstream coiler 104 to the upstream coiler 101, and the upper pinch roll 105*b* can press a strip via a hydraulic cylinder 121 to push down the strip. Also, the upper pinch roll 105*b* is provided with a pressing force detector 122 for detecting a pressing force applied to the upper pinch roll 105*b*.

The pressing force applied to the upper pinch roll 105*b* via the hydraulic cylinder 121 is determined by feedback controlling a servo valve 127 for switching oil supplied from a hydraulic pump 126 to the hydraulic cylinder 121 by a pinch roll pressing force controller 125 so that the detected pressing force obtained by the pressing force detector 122 coincides with the preset pressing force set beforehand by a compensation pressing force setter 124. The pressing force control for the pinch roll may be carried out by using air.

Next, a case where changeover from the downstream coiler 104 to the upstream coiler 101 is effected will be explained. First, while the preceding strip $S_1$ is coiled by the mandrel 107 of the downstream coiler 104, the lower pinch roll 105*a* of the upstream coiling pinch rolls 105 is moved to the upstream side along the pass line by a hydraulic cylinder (not shown). Thereby, the offset angle of the upstream coiling pinch rolls 105 is changed to change the transfer direction of a strip from the downstream coiler 104 to the upstream coiler 101 so that immediately after the preceding strip $S_1$ has gone through the upstream coiling pinch rolls 105, the following strip $S_2$ can be introduced to the upstream coiler 101. In FIG. 1, reference numeral 128 denotes a triangular gate for preventing the leading end of the following strip $S_2$ from going to the side of the downstream coiler 4.

When a strip is cut by the strip shear 102 in a state in which the preceding strip $S_1$ is coiled around the mandrel 107 of the downstream coiler 104, in the present invention, when the cutting operation is performed, the coiling speed $V_m$ of the preceding strip $S_1$ set by the speed controller 112 for the coiler 104, the target speed $V_{p2}$ for the speed controller 120 on the side of the upstream coiling pinch rolls 105, the target speed $V_{p1}$ for the speed controller 116 on the side of the downstream coiling pinch rolls 103, and the transfer speed $V_s$ of the following strip $S_2$ immediately after the cutting operation (=transfer speed of the strip just before the cutting operation) are set by a host computer (not shown) so that $V_m > V_{p1} > V_{p2} > V_s$.

The following is the detailed description.

When the cutting operation of strip performed by the strip shear 102 is finished in the state in which the preceding strip $S_1$ is coiled around the mandrel 107 of the downstream coiler 104, a cutting finish signal for telling that the cutting operation has finished is sent from the strip shear 102 or the host computer to the speed controller 112 for the downstream coiler 104, the speed controller 116 for the downstream coiling pinch rolls 103, and the speed controller 120 for the upstream coiling pinch rolls 105.

If the cutting finish signal is sent at time $t_0$, the mandrel 107 of the downstream coiler 104 is changed over from tension control by the torque controller 110 to speed control by the speed controller 112 at timing of the time $t_0$. At the same time, the speed controller 112 starts acceleration of coiling speed of strip at the timing of the time $t_0$, and also, as indicated by the curve I in FIG. 2, speed control is started so that the final speed $V_m$ after the completion of acceleration with the acceleration rate of X is expressed by the following equation (1).

$$V_m = V_s \times A \tag{1}$$

where, $V_s$ is the transfer speed of strip just before the cutting operation, and A is a lead coefficient (a coefficient for determining the final speed).

Figure 3A:
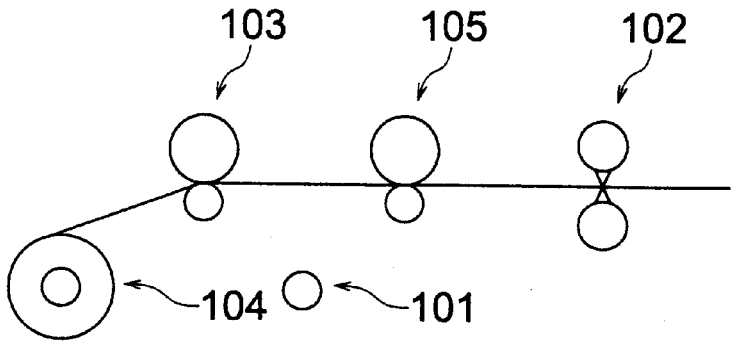
FIGS. 3A, 3B and 3C are explanatory views for illustrating a state of the preceding strip and the following strip in cutting and after cutting a strip.

The state of the preceding strip $S_1$ and the following strip $S_2$ at the time $t_0$ is as shown in FIG. 3(A).

During a delay time T1 from the time $t_0$ of the acceleration start to time $t_1$, the speed of the downstream coiling pinch rolls 103 is kept at the strip speed $V_s$, just before the cutting operation by the speed controller 116 for the downstream coiling pinch rolls 103. However, when the time $t_1$ is reached, the speed controller 116 starts the increase in speed of the downstream coiling pinch rolls 103, and also, as indicated by the curve II in FIG. 2, speed control is started so that the final speed $V_{p1}$ after the completion of acceleration with the acceleration rate of Y is expressed by the following equation (2). The time counting of the delay time T1 is performed by a timer provided on the speed controller 116 or the host computer.

$$V_{p1} = V_s \times B \tag{2}$$

where B is a lead coefficient, and the relationship between the lead coefficients A and B is A>B.

Further, during a delay time T2 from the time $t_0$ of the acceleration start to time $t_2$, the speed of the upstream coiling pinch rolls 105 is kept at the strip speed $V_s$ just before the cutting operation by the speed controller 120 for the upstream coiling pinch rolls 105. However, when the time $t_2$ is reached, the speed controller 120 starts the increase in speed of the upstream coiling pinch rolls 105, and also, as indicated by the curve III in FIG. 2, speed control is started so that the final speed $V_{p2}$ after the completion of acceleration with the acceleration rate of Z is expressed by the following equation (3). The time counting of the delay time T2 is performed by a timer provided on the speed controller 120 or the host computer (not shown), and the relationship between the delay times T1 and T2 is T1<T2.

$$V_{p2} = V_s \times C \tag{3}$$

where C is a lead coefficient, and the relationship between the lead coefficients B and C is B >C.

Figure 3B:
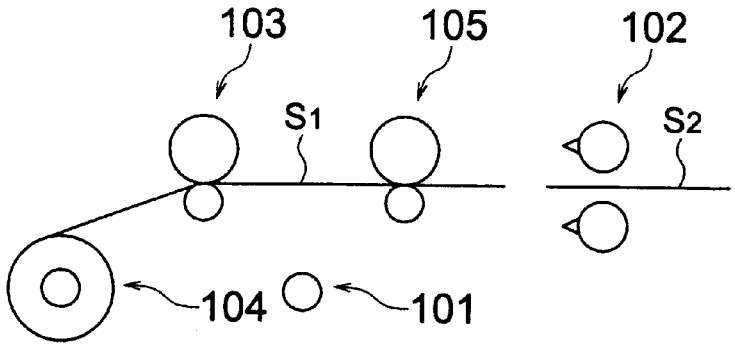

Thereafter, time $t_3$ is reached, as shown in FIG. 3(B), the tail end of the preceding strip $S_1$ and the leading end of the following strip $S_2$ are located between the upstream coiling pinch rolls 105 and the strip shear 102, and the tail end of the preceding strip $S_1$ is sufficiently separated from the leading end of the following strip $S_2$.

Figure 2:
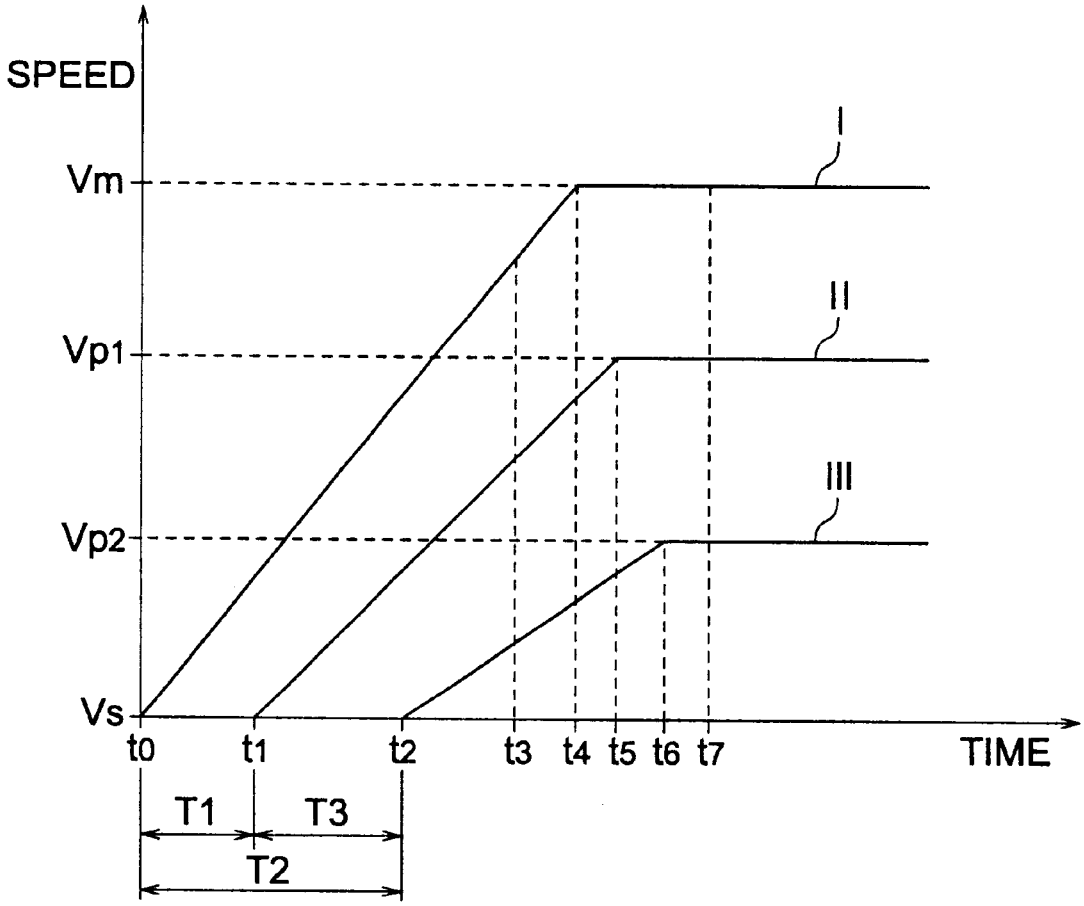
FIG. 2 is an explanatory view for illustrating one example of an operation pattern (speed pattern) of each part at the time of sing and coiling of a strip.

Further, as shown in FIG. 2, time $t_4$ is reached, the coiling speed of the mandrel 107 of the downstream coiler 104 becomes the final speed $V_m$ . When time $t_5$ is reached, the speed of the downstream coiling pinch rolls 103 becomes the final speed $V_{p1}$ . When time $t_6$ is reached, the speed of the upstream coiling pinch rolls 105 becomes the final speed $V_{p2}$.

Figure 3C:
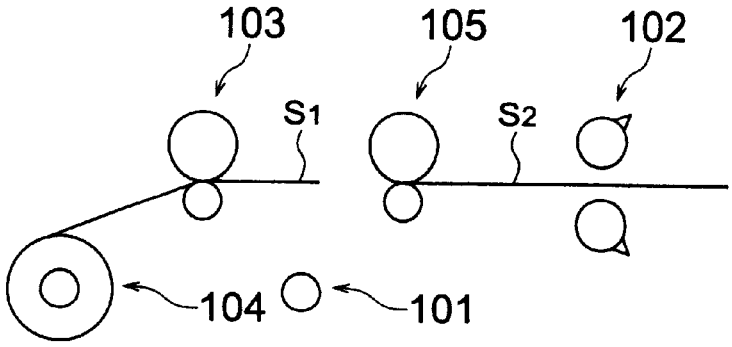

When time $t_7$ is reached, as shown in FIG. 3(C), the tail end of the preceding strip $S_1$ is located between the downstream pinch rolls 103 and the upstream coiling pinch rolls 105, and the leading end of the following strip $S_2$ reaches the upstream coiling pinch rolls 105.

Also, a speed ratio x of the final speed $V_m$ to the final speed $V_{p1}$ and a speed ratio y of the final speed $V_{p1}$ to the final speed $V_{p2}$ become as expressed by the following equations.

$$x = (A \cdot V_m)/(B \cdot V_{p1}) = A/B \tag{5}$$

$$y = (B \cdot V_{p1})/(C \cdot V_{p2}) = B/C \tag{6}$$

Therefore, for example, assuming that the lead coefficients A, B and C are A=1.5, B=1.1, and C=1.05, the speed ratios x and y are as follows.

$$\text{Speed ratio } x = (1.5/1.1) = 1.045 \tag{7A}$$

$$\text{Speed ratio } y = (1.1/1.05) = 1.048 \tag{7B}$$

The lead coefficients A, B and C are preferably higher from the viewpoint of the coiling property of strip on the downstream coiler 104. However, when the lead coefficients are high, deceleration energy at the time of coiling is applied to the strip, so that an excessive tension is produced on the strip after finish rolling, by which the width of strip decreases, presenting a quality problem. Therefore, the lead coefficients are determined empirically with an emphasis on the coiling property according to the sheet thickness.

Further, it is preferable that for the speed ratio in the acceleration process of the downstream coiler 104 and the downstream coiling pinch rolls 103, the above-described speed ratio x be ensured, and for the speed ratio in the acceleration process of the downstream coiling pinch rolls 103 and the upstream coiling pinch rolls 105, the above-described speed ratio y be ensured.

To ensure the above-described speed ratio x for the speed ratio in the acceleration process of the downAstream coiler 104 and the downstream coiling pinch rolls 103, the following equation holds by using Equation (5).

$$(V_s+X\cdot T1)/V_s=A/B \quad (8)$$

where X is the acceleration rate of the downstream coiler 104, and T1 is the delay time shown in FIG. 2.

By transforming Equation (8), the delay time T1 is expressed by the following equation. The delay time T1 may be set as given by the following equation.

$$T1=(V_s/X)(A/B-1) \quad (9)$$

Likewise, to ensure the above-described speed ratio y for the speed ratio in the acceleration process of the downstream coiling pinch rolls 103 and the upstream coiling pinch rolls 105, the following equation holds.

$$T=(V_s/Y)(B/C-1) \quad (10)$$

where Y is the acceleration rate of the coiling pinch rolls 103, and T3 is time from the acceleration start of the downstream coiling pinch rolls 103 to the acceleration start of the upstream coiling pinch rolls 105 as shown in FIG. 2. Therefore, the delay time T2 shown in FIG. 2 may be set so that T2=(T1+T3).

Further, it is necessary that the acceleration of the downstream coiler 104, the downstream coiling pinch rolls 103, and the upstream coiling pinch rolls 105 should be finished before the leading end of the following strip $S_2$ having been cut reaches the upstream coiling pinch rolls 5. Specifically, the relationship between the times $t_4$, $t_5$, $t_6$ and $t_7$ shown in FIG. 2 must meet the condition given by the following equation.

$$t_7>t_4,\ t_7>t_5,\ t_7>t_6 \quad (11)$$

Next, one example of the above condition will be explained in detail.

For example, assuming that the distance between the upstream coiling pinch rolls 105 and the strip shear 102 is 10 [m], and the speed $V_s$ of strip just before the cutting operation (=the transfer speed $V_s$ of the following strip $S_2$ immediately after the cutting operation) is 900 [mpm], the time taken for the following strip $S_2$ having been cut to reach the upstream coiling pinch rolls 105 is 10 m/(900 mpm/60 sec) =0.67 [sec].

Also, assuming that the lead coefficient A is 1.15, the final speed $V_m$ of the mandrel 107 of the downstream coiler 104 is $V_m$=900 ×1.15=1035 [mpm]. Also, since during 0.67 seconds, the speed increases from 900 [mpm] to 1035 [mpm], the acceleration rate X becomes (1035–900)/0.67= 201 [mpm/s].

By performing the speed setting in this manner, because the relationship of $V_{p2}>V_s$ holds between the strip shear 102 and the coiling pinch rolls 105, a pulling force directed to the downstream side is applied to the strip $S_1$ having been cut by the coiling pinch rolls 105. Also, because the relationship of $V_{p1}>V_{p2}$ holds between the coiling pinch rolls 105 and the coiling pinch rolls 103, a pulling force directed to the downstream side is applied to the strip $S_1$ by the coiling pinch rolls 103. Further, because the relationship of $V_m>V_{p1}$ holds between the coiling pinch rolls 103 and the mandrel 107 of the downstream coiler 104, a pulling force directed to the downstream side is applied to the strip $S_1$ by the mandrel 107.

Therefore, the tail end of the preceding strip $S_1$ is prevented from being oversupplied on the delivery side of the coiling pinch rolls 105, that is, between the coiler 104 and the downstream coiling pinch rolls 103 and between the downstream coiling pinch rolls 103 and the upstream coiling pinch rolls 105. As a result, damage to the strip caused by the tail end of the preceding strip $S_1$ being caught by a triangular gate 26 can be prevented. Further, because the feed speed of the coiling pinch rolls 105 is set so as to be higher than the transfer speed of the following strip $S_2$ as indicated by $V_{p2}>V_s$, the leading end of the following strip $S_2$ can be prevented from being oversupplied on the entrance side of the coiling pinch rolls 105.

If the pressing force on the strip caused by the upper pinch roll 105*b* is weak when the offset angle of the upstream coiling pinch rolls 105 is changed, the tail end of the strip coiled by the mandrel 107 of the downstream coiler 4 cannot be held sufficiently by the upstream coiling pinch rolls 105, so that the tail end of the strip is not pressed sufficiently by the upstream coiling pinch rolls 105 and undesirably slips. As a result, as shown in FIG. 18, the tail end of the strip is oversupplied between the downstream coiler 104 and the upstream coiler 101. Therefore, in this embodiment, a pressing force that can surely hold the strip by using the upstream coiling pinch rolls 105 is set, by which before the cutting operation is performed, the preceding strip $S_1$ is surely held by the upstream coiling pinch rolls 105.

The following is the detailed description.

In the case where the pressing force detector 122 for the upstream coiling pinch rolls 105 is provided on the side of the upper pinch roll 105*b* as shown in FIG. 1, when the offset angle of the upstream coiling pinch rolls 105 is changed in the state in which the preceding strip $S_1$ is coiled around the mandrel 107 of the downstream coiler 104, it is necessary that the preceding strip $S_1$ should be pressed down from the pass line according to the offset amount of the lower pinch roll 105*a*, and the strip $S_1$ should be held between the upper and lower pinch rolls 105*b* and 105*a*. In the example shown in FIG. 1, the upper pinch roll 105*b* of the upstream coiling pinch rolls 105 presses the preceding strip $S_1$ via the hydraulic cylinder 121, and the pressing force at this time is set by the compensation pressing force setter 124.

The compensation pressing force setter 124 sets a compensation pressing force for surely holding the preceding strip $S_1$ between the upper pinch roll 105*b* and the lower pinch roll 105*a* of the upstream coiling pinch rolls 105. After the offset angle of the upstream coiling pinch rolls 105 is changed, at proper timing during the time until the tail end of the preceding strip $S_1$ is cut by the strip shear 102, the speed controller 120 is controlled so that the speed reference of the lower pinch roll 105*a* is slightly lower than the sheet speed $V_s$ of the preceding strip $S_1$. In this state, the servo valve 127 is feedback controlled via the pinch roll pressing force controller 125 until the torque value T detected by the torque detector 118 becomes the preset value $T_0$, and the strip $S_1$ is pressed continuously.

In the case where the speed reference of the lower pinch roll 105*a* is made slightly lower than the sheet speed $V_s$ of the preceding strip $S_1$, unless the preceding strip $S_1$ is pressed with a desirable pressing force, a load is scarcely applied to the lower pinch roll 105*a*, so that the torque of the lower pinch roll 105*a* does not increase. If the preceding strip $S_1$ is pressed with the desirable pressing force, the preceding strip $S_1$ slips with respect to the lower pinch roll 105*a*, so that the load (torque) increases. By utilizing this, the compensation pressing force (in this case, the force that holds the preceding strip $S_1$ between the upper pinch roll 105*b* and the lower pinch roll 105*a*) $P_s$ (N) is estimated.

Taking the speed difference between the preceding strip $S_1$ and the lower pinch roll 105*a* as Δv (mpm), the coefficient of friction between the preceding strip $S_1$ and the lower pinch roll 105*a,* which changes according to the speed difference Δv, as $\mu_2$ (Δv), the actual torque of the lower pinch roll 105*a* as T (N·m), and the radius of the lower pinch roll 105*a* as r (m), the force $P_s$ (N) for holding the preceding strip $S_1$ between the upper pinch roll 105*b* and the lower pinch roll 105*a* is expressed as $$P_s=T/[r\cdot\mu_2(\Delta v)] \quad (12)$$

Therefore, if the value of $\mu_2$ at the time of a predetermined speed difference Δv is determined beforehand from Equation (12), the compensation pressing force $P_s$ can be determined by measuring the actual torque T of the lower pinch roll.

In the pressing force setting method by using the compensation pressing force setter 124, even if the strip is cut by the strip shear 102, the compensation pressing force $P_{s1}$ that can hold the strip $S_1$ between the upstream coiling pinch rolls 105 to a degree such that the tail end of the preceding strip $S_1$ does not wrinkle is determined beforehand, and when before the cutting operation is performed, the speed of the lower pinch roll 105*a* is set so as to be lower than the sheet speed $V_s$ of the strip $S_1$ by the predetermined speed Δv, the torque value $T_0$ of the lower pinch roll 105*a* at the time when the compensation pressing force is $P_{s1}$ is preset in the compensation pressing force setter 124. Before the cutting operation is performed, the compensation pressing force setter 124 sends a signal to the speed controller 120 so that the speed of the lower pinch roll 105*a* is lower than the sheet speed $V_s$ by Δv, and then sends a signal to the pinch roll pressing force controller 125 so that the strip $S_1$ is pressed by the upper pinch roll 105*b* while measuring the actual torque T of the lower pinch roll 105*a* by using the torque detector 118. The actual torque T is made a value not lower than $T_0$. Therefore, the strip $S_1$ can be held surely between the upstream coiling pinch rolls 105. In this state, the tail end of the preceding strip $S_1$ is cut by the strip shear 102.

When the compensation pressing force setter 124 is used in this manner, since the pressing force is set considering the actual force applied to the preceding strip $S_1$, the preceding strip $S_1$ can be held surely between the upper pinch roll 105*b* and the lower pinch roll 105*a* of the upstream coiling pinch rolls 105, whereby the occurrence of slip can be prevented. As a result, the tail end of the preceding strip $S_1$ can be prevented satisfactorily from being oversupplied between the downstream coiler 1 and the upstream coiler 6.

The control for ensuring the speed relationship of $V_m > V_{p1} > V_{p2} > V_s$ by using the host computer and the pressing of the preceding strip $S_1$ by using the compensation pressing force setter 24 are carried out until the tail end of the preceding strip $S_1$ is coiled around the mandrel 107 of the downstream coiler 104.

Also, in this embodiment, the case where a strip is coiled by the mandrel 107 of the downstream coiler 104 has been described. However, the present invention can be applied to the case where a strip is coiled by the mandrel 107 of the upstream coiler 101.

Next, a strip coiling method on a hot rolling line on which a Carrousel reel type coiler is arranged, which is a second embodiment of the present invention, will be described with reference to FIG. 4. Both of the Carrousel reel type coiler and the continuous hot rolling line have the same basic configuration as that of the conventional example (FIGS. 20 and 21) described before. Therefore, the same reference numerals are applied to the same elements, and the duplicated explanation is omitted.

Figure 4:
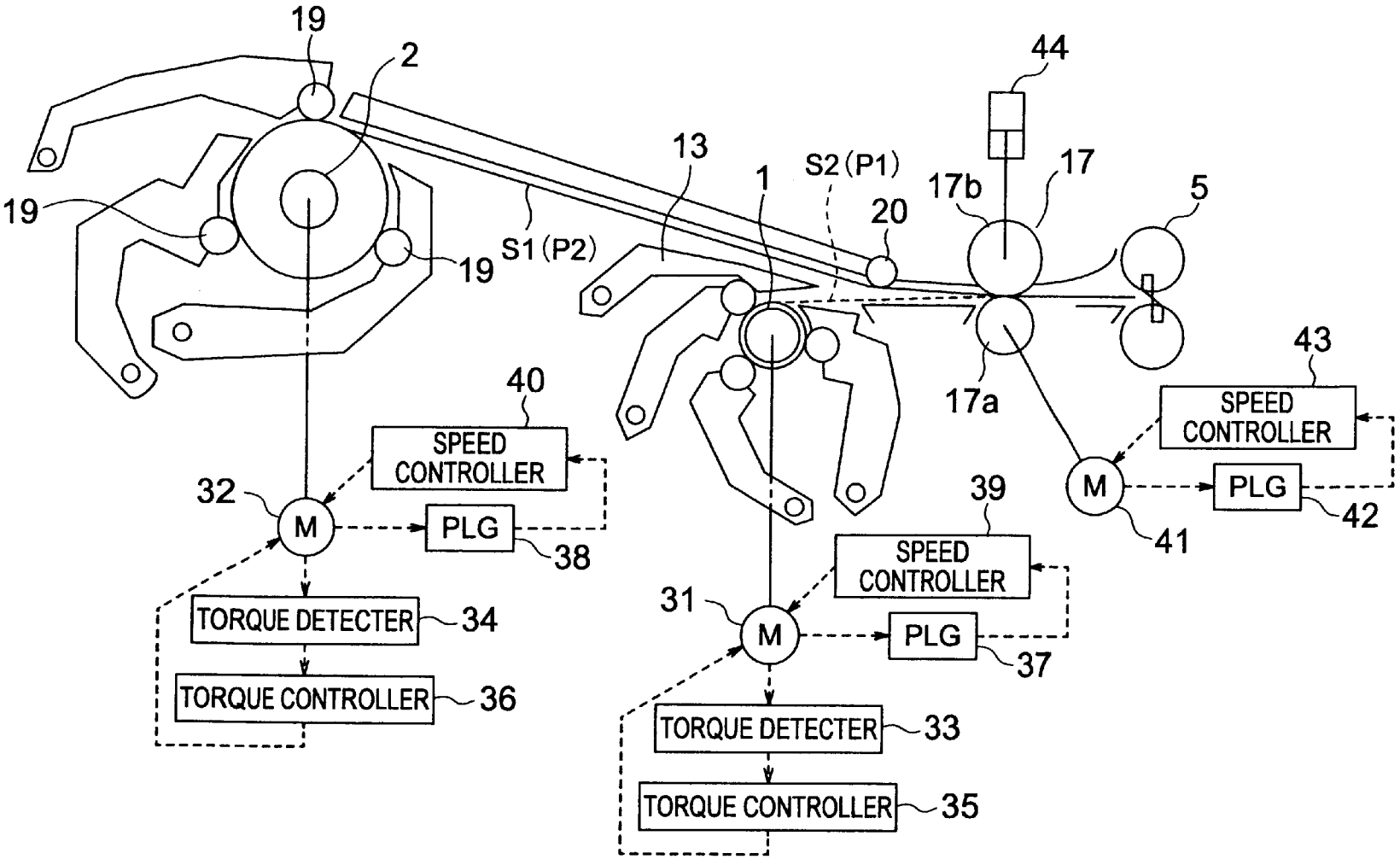
FIG. 4 is an explanatory view for illustrating a strip coiling method accordance with a second embodiment of the present invention.

FIG. 4 schematically shows a portion of a continuous hot rolling line on the downstream side of a strip shear. In this embodiment, a case where a strip sent from a finishing mill (not shown) is cut to a predetermined length by using a strip shear 5, and the preceding strip $S_1$ is coiled by a mandrel at a coiling finish position (a second mandrel 2 in the figure) via coiling pinch rolls 17 disposed on the delivery side of the strip shear 5, whereas the following strip $S_2$ is coiled by a mandrel at a coiling start position (a first mandrel 1 in the drawing) via coiling pinch rolls 17 is explained by way of example.

The second mandrel 2 located at the coiling finish position is provided with a torque detector 34 for detecting a torque of a motor 32 for driving the mandrel 2, a torque controller 36 for keeping the tension of a strip constant by feedback controlling the motor 32 so that the detected torque value obtained by the torque detector 34 coincides with the target torque value, a pilot generator (PLG) 38 for detecting the rotational state of the motor 32, and a speed controller 40 for feedback controlling the motor 32 so that the speed detection value obtained by the pilot generator 38 coincides with the target speed, as means for pulling a strip coiled around the mandrel 2 with a predetermined coiling tension.

The first mandrel 1 located at the coiling start position is also provided with a torque detector 33 for detecting a torque of a motor 31 for driving the mandrel 1, a torque controller 35 for keeping the tension of the strip constant by feedback controlling the motor 31 so that the detected torque value obtained by the torque detector 33 coincides with the target torque value, a pilot generator (PLG) 37 for detecting the rotational state of the motor 31, and a speed controller 39 for feedback controlling the motor 31 so that the speed detection value obtained by the pilot generator 37 coincides with the target speed, as means for pulling a strip coiled around the mandrel 1 with a predetermined coiling tension.

Further, the coiling pinch rolls 17 have a pilot generator (PLG) 42 for detecting the rotational state of a motor 41 for a lower pinch roll 17*a,* and a speed controller 43 for feedback controlling the motor 41 so that the speed detection value obtained by the pilot generator 42 coincides with the target speed $V_p$. An upper pinch roll 17*b* of the coiling pinch rolls 17 is capable of pressing a strip via a hydraulic cylinder 44 for pressing the strip toward the lower pinch roll 17*a*.

Next, a case where changeover is effected from the mandrel at the coiling finish position (the second mandrel 2 in the figure) to the mandrel at the coiling start position (the first mandrel 1 in the figure) will be explained. First, the upper pinch roll 17*b* of the coiling pinch rolls 17 is pushed down by the hydraulic cylinder 44 so that the preceding strip $S_1$ is held between the upper pinch roll 17*b* and the lower pinch roll 17*a* while the strip $S_1$ is coiled by the second mandrel 2. In this state, the tail end of the strip $S_1$ is cut by the strip shear 5. In this embodiment, the relationship between the coiling speed $V_m$ of the preceding strip $S_1$ set by the speed controller 40 for the mandrel 2 after the cutting operation, the target speed $V_p$ for the speed controller 43 for the coiling pinch rolls 17 at the time of the cutting operation, and the sheet speed $V_s$ of the preceding strip $S_1$ just before the cutting operation is set by a host computer (not shown) so that $V_m > V_p > V_s$.

By performing the speed setting in this manner, because the relationship of $V_p > V_s$. holds between the strip shear 5 and the coiling pinch rolls 17, a pulling force directed to the downstream side is applied to the strip $S_1$ having been cut by the coiling pinch rolls 17. Also, because the relationship of $V_m > V_p$ holds between the coiling pinch rolls 17 and the mandrel 2, a pulling force directed to the downstream side is applied by the mandrel 2.

Therefore, the preceding strip $S_1$ can be prevented from oversupplied on the delivery side of the coiling pinch rolls 17. As a result, damage to a sheet caused by the preceding strip $S_1$ being caught by the tip end of a downstream sheet guide 13 lying at a position where a downstream pass line $P_2$ branches off an upstream pass line $P_1$. Further, because the speeds are set so that the relationship of $V_p>V_s$ holds, that is, the feed speed $V_p$ of the coiling pinch rolls 17 is higher than the transfer speed $V_s$ of the following strip $S_2$, the leading end of the following strip $S_2$ can be prevented from being oversupplied at the entrance side of the coiling pinch roll 17. For the sheet speed $V_s$, an actual value can be determined from the target speed of the mandrel 2 just before the cutting operation or the roll rotational speed of the finishing mill. The speeds $V_m$ and $V_p$ may be set so as to meet the above condition based on the actual value of the sheet speed $V_s$.

Before the cutting operation is performed, a tension can be given to the strip $S_1$ by the finishing mill and the mandrel 2, and the coiling control executed by the mandrel 2 before that is preferably carried out by controlling the coiling torque.

Specifically, the motor 32 is feedback controlled so that the detected torque value of the motor 32 obtained by the torque detector 34 coincides with the target torque value in order to keep the tension of the strip $S_1$ constant. Then, the tail end of the strip $S_1$ is cut by the strip shear 5, and after awhile, the speed of the mandrel 2 is decreased and the rotation thereof is stopped while the strip $S_1$ coiled into a coil shape is pressed by wrapper rolls 19. After the rotation of the mandrel 2 is stopped, the coil of the strip $S_1$ is removed from the mandrel 2.

Also, after the strip $S_1$ is cut by the strip shear 5, a tension cannot be given to the strip $S_1$ between the finishing mill and the mandrel 2. Therefore, after the cutting operation, the coiling control executed by the mandrel 2 is changed over from torque control to speed control. Thereby, before the cutting is performed, a tension can be applied to the strip $S_1$ by the torque control to coil the strip $S_1$ tightly, and after the cutting is performed, the coiling speed of the strip $S_1$ can be set so that $V_m>V_p>V_s$ as described above.

The coiling control of the mandrel 2 may be changed over from torque control to speed control in advance before the preceding strip $S_1$ is cut by the strip shear 5.

Figure 5:
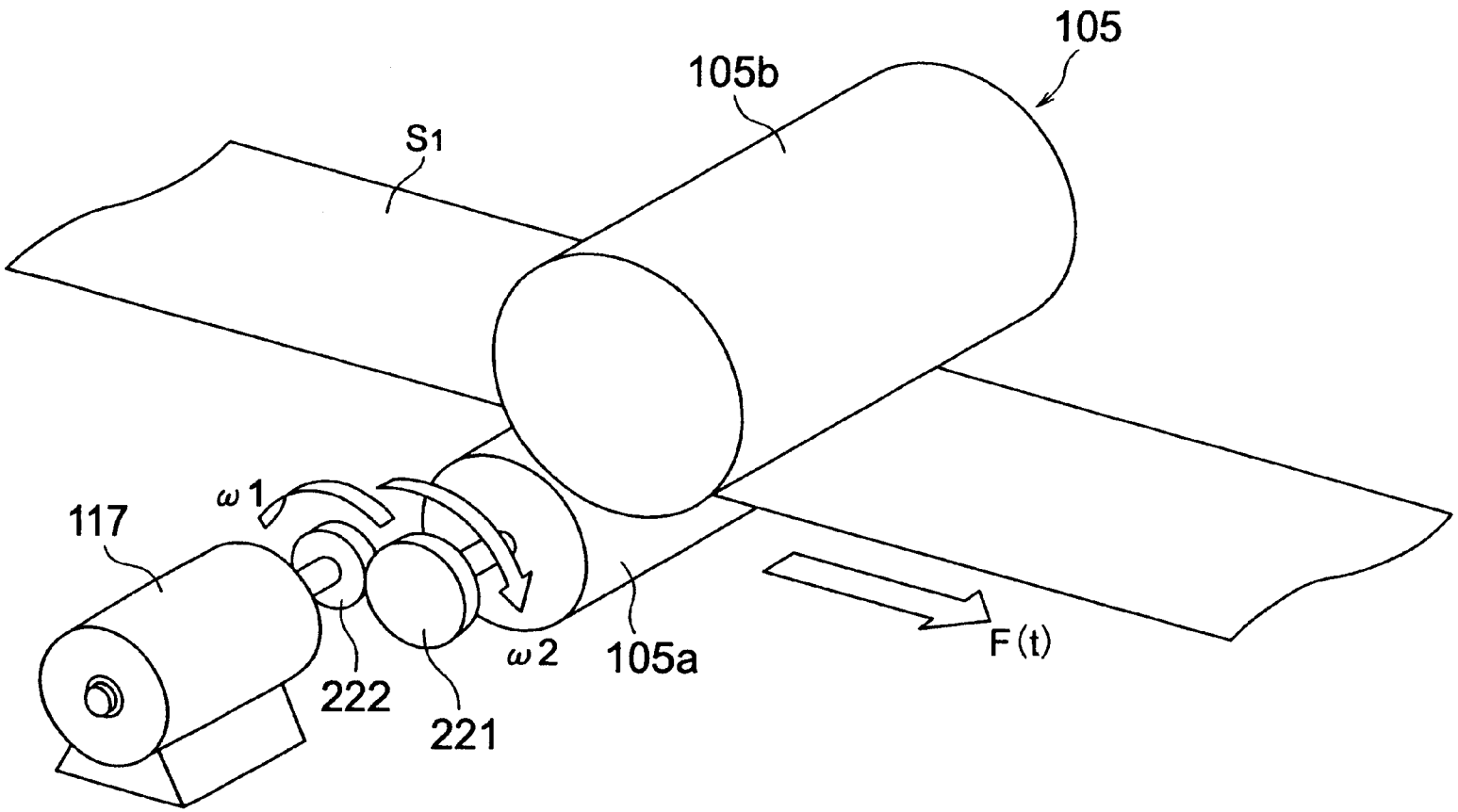
FIG. 5 is a schematic perspective view of a driving mechanism for coiling pinch rolls on the delivery side of a strip shear, the view being used for illustrating a strip coiling method accordance with a third embodiment of the present invention.

Next, a strip coiling method in accordance with a third embodiment of the present invention will be described with reference to FIGS. 5 to 7. Although this embodiment can be applied to the above-described first and second embodiments, a case where it is applied to the first embodiment will be described by way of example. In this embodiment, therefore, the same reference numerals are applied to the same elements in FIG. 1, and the duplicated explanation of the first embodiment is omitted.

Before a strip is cut, the coiling pinch rolls 105 on the delivery side of the strip shear rotate at the same speed as the target sheet speed $V_s$ (m/s) of the strip. When the strip is cut by the shear strip 102, the target sheet speed $V_{p2}$ (m/s) of the coiling pinch rolls 105 is set at a value higher than the target sheet speed $V_s$ of the strip, and the preset coiling speed $V_m$ (m/s) of the preceding strip $S_1$ is set at a value higher than the target sheet speed $V_{p2}$ of the coiling pinch rolls 105. Therefore, the rotational speed of the coiling pinch rolls 105 increases after the strip is cut. The sheet speed of the preceding strip $S_1$ tends to increase to the preset coiling speed $V_m$. Since the coiling pinch rolls 105 press the preceding strip $S_1$, the rotational speed of the coiling pinch rolls 105 sometimes increases to a value close to the preset coiling speed $V_m$ along with the increase in the sheet speed of the preceding strip $S_1$.

At this time, the target sheet speed $V_{p2}$ of the coiling pinch rolls 105 is set at the preset coiling speed $V_m$, that is, a value lower than the sheet speed of the preceding strip $S_1$ having been cut, so that the motor 117 (a driving unit) for the lower pinch roll 105*a* of the coiling pinch rolls 105 produces a torque such that the speed of the coiling pinch rolls 105 is decreased. Therefore, after the cutting operation, the load torque of the motor 117 changes from the direction of forward rotation to the direction of reverse rotation. After the tail end of the preceding strip $S_1$ has gone through the coiling pinch rolls 105, the speed of the coiling pinch rolls 105 decreases. In the case where the strip has a great sheet thickness and high bending rigidity, however, a force for pressing the preceding strip $S_1$ caused by the coiling pinch rolls 105 is large, so that the torque on the deceleration side of the motor 117 when the preceding strip $S_1$ passes between the coiling pinch rolls 105 becomes high. Therefore, when the speed of the coiling pinch rolls 105 decreases after the tail end of the preceding strip $S_1$ has passed between the coiling pinch rolls 105, in spite of the speed setting of $V_{p2}>V_s$, as shown in FIG. 7, the rotational speed of the coiling pinch rolls 105 momentarily takes a value lower than the target sheet speed of strip (the speed of the following strip), and thereafter the rotational speed stabilizes into the preset sheet speed $V_{p2}$.

The time from when the tail end of the preceding strip $S_1$ has gone through the coiling pinch rolls 105 to when the leading end of the following strip $S_2$ is bitten by the coiling pinch rolls 105 is as short as about 0.3 second. Therefore, if the leading end of the following strip $S_2$ is bitten by the coiling pinch rolls 105 when the rotational speed of the coiling pinch rolls 105 is lower than the sheet speed $V_s$ of the following strip $S_2$ as described above, the strip feed speed of the coiling pinch rolls 105 becomes lower than the sheet speed of the following strip $S_2$, so that, as shown in FIG. 19, the leading end or the following strip $S_2$ is oversupplied on the entrance side of the coiling pinch rolls 5.

In this embodiment, therefore, a deceleration-side torque limit $T_{max}$ (N·m) is set on the motor 117, which is the driving unit for the coiling pinch rolls 105, by which the motor 117 is controlled by the speed controller 120 so that the load torque of the motor 117 does not exceed the deceleration-side torque limit $T_{max}$.

Figure 6:
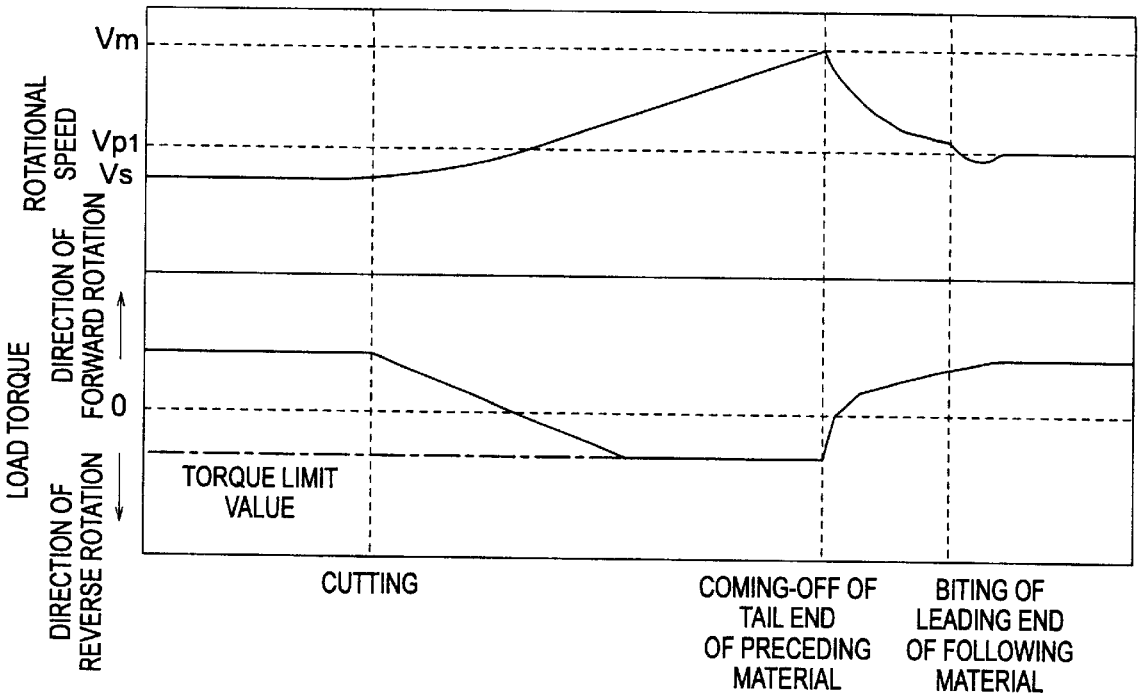
FIG. 6 is a graph showing a time change of the rotational speed and load torque of the coiling pinch roll on the delivery side of the star in the case where a torque limit on a deceleration side is set.
Figure 7:
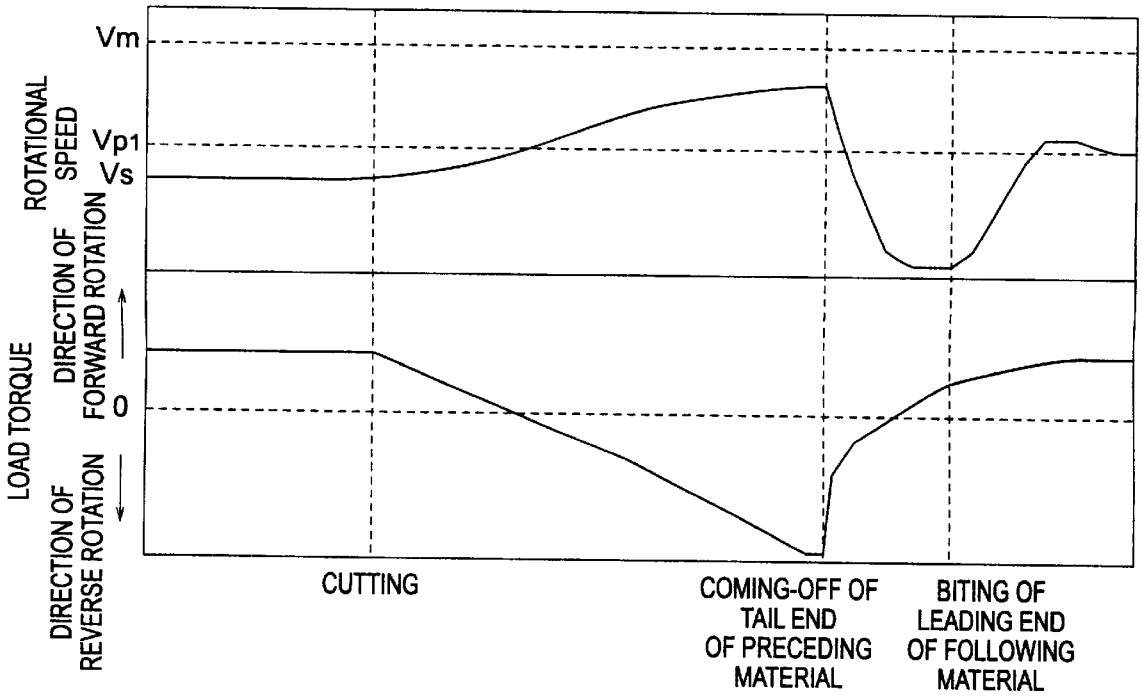
FIG. 7 is a graph showing a time change of the rotational speed and load torque of the coiling pinch roll on the delivery side of the strip shear in a case where a torque limit on the deceleration side not set.

The value of the torque limit $T_{max}$ such that when the leading end of the following strip $S_2$ is bitten by the coiling pinch rolls 105, the rotational speed of the coiling pinch rolls 105 is not lower than the sheet speed $V_s$ of the following strip $S_2$ as shown in FIG. 6 can be determined beforehand as described below.

The value of the torque limit $T_{max}$ to be set on the motor 117 for driving the lower pinch roll 105*a* will be explained with reference to FIG. 5 taking a case where the lower pinch roll 105*a* of the coiling pinch rolls 105 is driven as an example.

The lower pinch roll 105*a* is driven by the motor 117 via gears 221 and 222. FIG. 5 shows a state in which the preceding strip $S_1$ is pressed by the pinch rolls 105. In this state, the sheet speed $V_s$ of the preceding strip $S_1$ is higher than the preset sheet speed $V_{p2}$ of the lower pinch roll 105*a*, so that the lower pinch roll 105*a* is subjected to a force of F (N) from the preceding strip $S_1$, and the motor 117 produces a torque $T_M$ (N·m) against this force.

Taking a force which the lower pinch roll 105*a* is subjected to from the preceding strip $S_1$ at time t as F(t) (N), a torque which the motor 117 produces against this force as $T_M(t)$ (N·m), a moment of inertia between the lower pinch roll 105*a* and the gear 221 as $J_2$ (N·m$^2$), a moment of inertia between the motor 117 and the gear 222 as $J_1$ (N·m$^2$), an angular velocity of the lower pinch roll 105*a* just before the tail end of the preceding strip $S_1$ goes through the coiling pinch rolls 105 as $\omega_2$ (rad/sec), an angular velocity of the motor 117 as $\omega_1$ (rad/sec), a torque produced on the gear 222 as T(t) (N·m), the speed reducing ratio of the gear 221 to the gear 222 as i, and the roll diameter of the lower pinch roll 105*a* as D (m), a dynamic equation of Equation (13) holds. The sign of $T_M$ is such that the torque on the forward rotation side (acceleration side) is +, and the torque on the reverse rotation side (deceleration side) is −.

$$\frac{1}{i}T_{(t)} - F_{(t)}\frac{D}{2} = J_2\frac{d\omega_2}{dt} \tag{13}$$

Also, a dynamic equation of Equation (14) holds between the motor 117 and the gear 222.

$$T_{M(t)} - T_{(t)} = J_1\frac{d\omega_1}{dt} \tag{14}$$

Eliminating T(t) from Equations (13) and (14), the following equation (15) holds.

$$T_{M(t)} - i\cdot F_{(t)}\frac{D}{2} = (J_1 + J_2\cdot i^2)\frac{d\omega_1}{dt} \tag{15}$$

Integration of Equation (15) yields the following Equation (16).

$$\int_{t1}^{t2}\left(T_{M(t)} - i\cdot F_{(t)}\cdot\frac{D}{2}\right)dt = (J_1 + J_2\cdot i^2)\int_{\omega_{t1}}^{\omega_{t2}} d\omega_1 \tag{16}$$

where $\omega t_1$ and $\omega t_2$ are the angular velocities of the lower pinch roll 105*a* at times $t_1$ and $t_2$, respectively. In Equation (16), for the time from when the tail end of the preceding strip $S_1$ has gone through the coiling pinch rolls 105 to when the leading end of the following strip $S_2$ is bitten by the coiling pinch rolls 105, F(t) is equal to zero.

Here, a speed change amount $\Delta\omega$ (rad/sec) of the lower pinch roll 105*a* for the time from when the tail end of the preceding strip $S_1$ has gone through the coiling pinch rolls 105 (t=0) to when the leading end of the following strip $S_2$ is bitten by the coiling pinch rolls 105 (t=$t_2$ (sec)) is calculated. The minus sign of $\Delta\omega$ means deceleration, and the plus sign thereof means acceleration.

Thereupon, Equation (16) is expressed by the following equation (16A).

$$\int_0^{t2} T_{M(t)}\,dt = (J_1 + J_2\cdot i^2)\int_{\omega_0}^{\omega_{t2}} d\omega_1 \tag{16A}$$

The value $T_{M(t)}$ changes from $T_{max}$ to the plus side when the preceding strip $S_1$ goes through the coiling pinch rolls 105. To evaluate the change amount $\Delta\omega$ in a severer (larger) direction, it is simply assumed that $T_{M(t)}=T_{max}$, by which the following equation (17) holds.

$$\int_0^{t2} T_{\max}\cdot dt = (J_1 + J_2\cdot i^2)\int_{\omega_0}^{\omega_{t2}} d\omega_1 \tag{17}$$

By reducing Equation (17), the change amount $\Delta\omega$ of the lower pinch roll time $t_2$ after the tail end of the preceding strip $S_1$ goes through the pinch rolls is expressed by the following equation (18).

$$\Delta\omega = \frac{T_{\max}\cdot t_2}{J_1 + J_2\cdot i^2} \tag{18}$$

If the transfer speed $V_s$ of the leading end of the following strip $S_2$ satisfies the following equation (19), oversupplying of the leading end of the following strip $S_2$ on the entrance side of the lower pinch roll 105*a* does not occur.

$$V_s \le (\omega_0 + \Delta\omega)\frac{D}{2} \tag{19}$$

Since $\omega_0$ is not lower than a preset angular velocity $\omega_{p2}$ of the lower pinch roll 105*a,* there is no problem even when an approximation of $\omega_0 \approx \omega_{p2}$ is given. Therefore, $T_{max}$ for preventing the occurrence of oversupplying of the leading end of the following strip $S_2$ on the entrance side of the coiling pinch rolls 105 has only to satisfy the relationship of the following equation (20-4) from Equations (18) and (19).

$$V_s \le (\omega_0 + \Delta\omega)\frac{D}{2} = \left(\omega_{P2} + \frac{T_{\max}\cdot t_2}{J_1 + J_2\cdot i^2}\right)\times\frac{D}{2} \tag{20-1}$$

$$\frac{V_s\times 2}{D} - \omega_{P2} \le \frac{T_{\max}\cdot t_2}{J_1 + J_2\cdot i^2} \tag{20-2}$$

$$\frac{(J_1 + J_2\cdot i^2)}{t_2}\cdot\left(\frac{2V_s}{D} - \omega_{P2}\right) \le T_{\max} \tag{20-3}$$

$$\frac{2(J_1 + J_2\cdot i^2)(V_s - \omega_{p2}\cdot D/2)}{Dt_2} \le T_{\max} \tag{20-4}$$

From Equation (20-4), $V_s-\omega_{p2}\cdot D/2=V_s-V_{p2}$, which means $V_{p2}>V_s$. Therefore, it is found from Equation (20-4) that $T_{max}$ takes a value not lower than a minus value. That is to say, the deceleration-side torque limit is calculated.

The transfer speed $V_s$ of the leading end of the following strip $S_2$, the moment of inertia $J_1$ between the motor 117 and the gear 222, the moment of inertia $J_2$ between the lower pinch roll 105*a* and the gear 221, the diameter D of the lower pinch roll 105*a,* the speed reducing ratio i, and the preset angular velocity $\omega_{p2}$ of the lower pinch roll 105*a* have been found in advance. Also, the time $t_2$ from when the tail end of the preceding strip $S_1$ goes through the coiling pinch rolls 105 to when the leading end of the following strip $S_2$ is bitten by the coiling pinch rolls 105 has been found in advance from the relationship between the transfer speed $V_s$ of the following strip $S_2$ and the coiling speed $V_m$ of the preceding strip $S_1$. Therefore, the value of $T_{max}$ that satisfies Equation (20-4) has only to be set in advance.

If the deceleration-side torque limit $T_{max}$ is set on the motor 117 for driving the coiling pinch rolls 105 beforehand in this manner, while the coiling pinch rolls 105 presses the preceding strip $S_1$ after the strip is cut, the load torque on the deceleration side of the motor 117 created based on a speed difference between the target coiling speed $V_m$ of the preceding strip $S_1$ (the preset coiling speed of the downstream coiler 104) and the target sheet speed $V_{p2}$ of the coiling pinch rolls 105 does not become excessive. Even immediately after the tail end of the preceding strip $S_1$ goes through the coiling pinch rolls 105, the rotational speed of the coiling pinch rolls 105 does not become lower than the sheet speed $V_s$ of the following strip $S_2$.

Next, a strip coiling method in accordance with a fourth embodiment of the present invention will be described with reference to FIGS. 8 to 10.

In coiling a strip in continuous hot rolling, stable sheet transfer and coiling are performed by giving a tension to the strip between the finishing mill and the mandrel. As means for giving the tension, the tension reference given to the strip when the strip is coiled, that is, the tension reference preset properly so as to correspond to the coiling temperature condition in coiling, the steel type of strip to be coiled, or the like is generally given in advance, and tension control is carried out in coiling by producing a rotational torque on the mandrel in coiling, which torque is such that a tension having a value equal to the tension reference can be given to the strip.

In continuous hot rolling, a strip sent from the finishing mill is coiled by a plurality of mandrels alternately after being cut. Therefore, the time from coiling finish to coiling start of next strip per one mandrel is short, so that a coil (strip) having been coiled must be removed in the shortest possible time, and preparation for next coiling must be completed in a short time. For this purpose, it is necessary to stop the rotation of mandrel in a short time after the completion of coiling. However, since the wrapper roll (pressing roll) is brought into contact with the strip surface coiled in a coil shape before the completion of coiling, the wrapper roll produces a torque such as to hinder the rotation of mandrel during coiling operation, so that the speed of the mandrel itself is undesirably decreased. As a result, a looseness of strip occurs between the wrapper roll and the pinch roll, so that a phenomenon of oversupplying of strip takes place.

Figure 8:
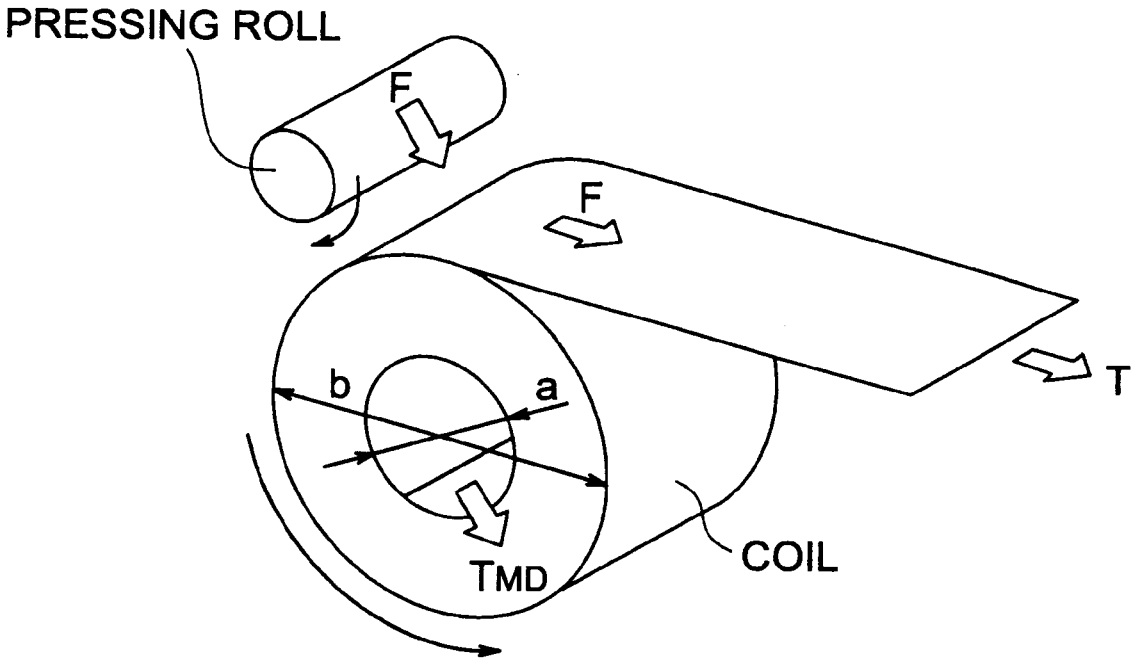
FIG. 8 is a view for illustrating a fourth embodiment of the present invention, showing a dynamic model of a coiling.

To simulate this phenomenon by a general hot rolling coiling model, the coil is assumed to be a rigid body of rotation, by which a model shown in FIG. 8 can be thought.

Specifically, taking the inside diameter of coil as a (m), the outside diameter thereof as b (m), the tension acting on the strip as T (KN), the torque occurring on the mandrel as $T_{MD}$ (KN·m), the inertia force of coil as $I_c$, and the angular velocity thereof as ω (rad/s), an equation derived by the dynamics of motion of the coil is expressed as $$I_c(d\omega/dt)=T_{MD}(a/2)-T(b/2)-4F \quad (21)$$

where F is the tension produced by one wrapper roll. A coiler in a general hot rolling shop is provided with four wrapper rolls.

In the above-described equation (21), at a stage before the wrapper roll comes into contact with the strip, the third term in the right-hand side is zero. In a case where the mandrel carries out tension control steadily, the occurring torque on the mandrel is controlled so that the first term and the second term are balanced, and therefore the left-hand side of the equation becomes zero.

In a non-steady state at the moment when the wrapper roll comes into contact with the strip, the left-hand side of the equation becomes minus, so that a negative angular velocity occurs. That is, the speed of the mandrel decreases. In this case, the tension given to the strip decreases, and the strip loosens between the wrapper roll and the pinch roll. This looseness causes defective coiling such as loosened coil outer coiling and telescoping.

In this embodiment, therefore, stable coiling of strip in continuous hot rolling is achieved. Although this embodiment can be applied to the above-described first and second embodiments, a case where it is applied to the second embodiment is described by way of example. In this embodiment, therefore, the same reference numerals are applied to the same elements in FIG. 4, and the duplicated explanation of the second embodiment is omitted.

In this embodiment, for example, when a strip is cut by the strip shear 5, the rotation control of the motor 32 for the mandrel 2 lying at the coiling finish position is changed over from the torque control having been carried out to the rotational speed control. Specifically, the changeover to the rotational speed control may be effected at timing when the strip shear 5 is operated. Alternatively, since if the strip is cut by the shear 5 in a state in which the torque control of the mandrel 2 is carried out, the tension having been given to the strip is released, and therefore the rotational speed of the mandrel increases, an upper limit value of the rotational speed may be set in advance so that when the actual rotational speed reaches the aforementioned value, the changeover to the speed control is effected automatically.

The wrapper rolls 19 are arranged at equal intervals along the outer periphery of the coil. They are provided retractably with respect to the mandrel 2 via a hydraulic pump and a hydraulic cylinder provided with a servo valve (both not shown), and is capable of being rotated by a driving power source (not shown). In this embodiment, after the mandrel 2 is changed over to the rotational speed control at the time when the cutting operation is performed, the wrapper rolls 19 are brought into contact with the outer peripheral surface of coil to brake the coil. The wrapper rolls 19 also function as a guide when the coiling operation of strip is started by the mandrel 2. Also, the relative position of the wrapper coil 19 with respect to the coil may be detected by using a position detector (not shown) to increase the accuracy of contact with the coil.

Next, in a case where the torque control of the mandrel 2 of the coiler is continued until the completion of coiling of strip as before and in a case where the torque control of the mandrel 2 is switched to the rotational speed control along with the cutting of strip just before the completion of coiling, actual changes of the rotational speed (sheet speed: mpm) and torque of the mandrel 2 were measured.

Figure 9:
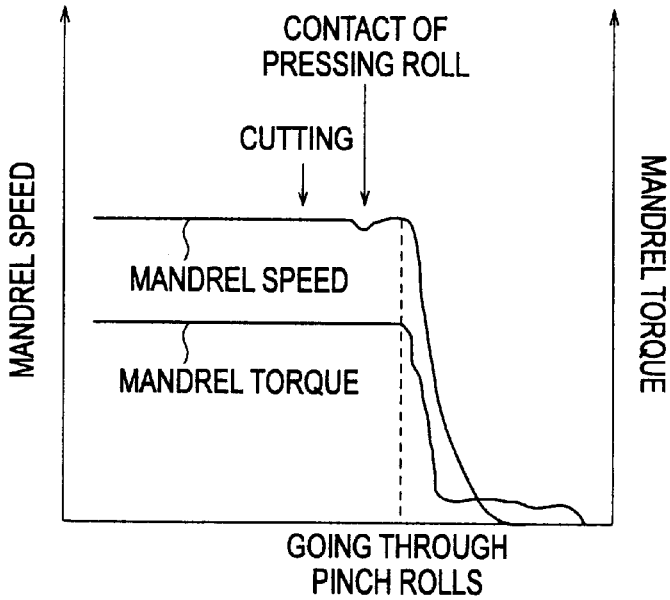
FIG. 9 is a graph showing a measurement result of the speed and torque of a mandrel at a stage at which coiling is finished.
Figure 10:
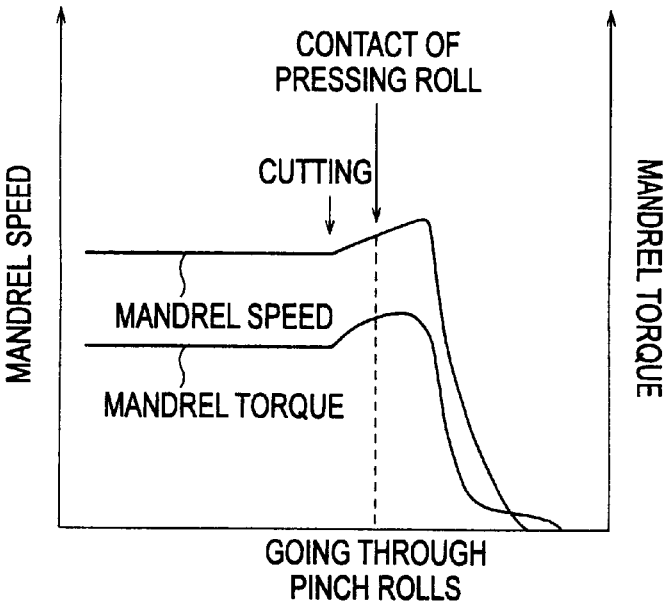
FIG. 10 is a graph showing a measurement result of the speed and torque of a mandrel at a stage at which coiling is finished.

The measurement results are shown in FIGS. 9 and 10. FIG. 9 shows the case where the torque control was continued, and FIG. 10 shows the case where the torque control was switched to the rotational speed control. Specifically, in FIG. 9, a decrease in rotational speed of mandrel when the wrapper rolls 19 come into contact with the coil is shown definitely. However, when the control is changed over to the speed control at the time of strip cutting as shown in FIG. 10, it is found that the decrease in rotational speed of mandrel is less, and the coil is not loosened.

Here, it is preferable that the rotational speed of the mandrel 2 be higher than the transfer speed of the preceding strip $S_1$. The reason for this is that when the mandrel 2 is switched from the torque control to the rotational speed control, by setting the target of the speed control value so as to be somewhat higher the actual speed at that time, the mandrel 2 can surely pull the strip.

Also, by setting the time when the wrapper rolls 19 begin to come into contact with the coil between the time when the strip is cut and the time when the strip goes through the coiling pinch rolls 17, the wrapper rolls 19 can be brought into contact with the coil while the mandrel 2 is subjected to speed control, and also the wrapper rolls 19 can quickly start an operation for braking the rotation of the coil.

The following is a description of another mode.

As described above, before the strip is cut by the strip shear 5, the mandrel 2 is subjected to torque control so that the strip coiled around the mandrel 2 is pulled with a predetermined coiling tension, by which coiling is performed. Thereafter, the strip is cut by the strip shear 5. Here, after the cutting operation, the torque control of the mandrel 2 is continued. After the strip is cut, the coiling operation is continued in a state in which a tension is given to the strip by the pinch rolls 17 and the mandrel 2.

Next, when the wrapper rolls 19 are brought into contact with the coil, if the mandrel 2 performs the coiling operation with a torque such that the same tension as before is given to the strip, at the moment when the wrapper rolls 19 are brought into contact with the coil, the rotational speed of the mandrel 2 decreases, and therefore the tension decreases, resulting in the occurrence of looseness of coiling. Therefore, when the wrapper rolls 19 are brought into contact with the outer peripheral surface of coil, the preset value of the tension is changed to a value higher than the previous preset value. In the above-described equation (21), the strip tension is decreased by 4F by bringing four wrapper rolls 19 into contact with the outer peripheral surface of coil, so that the preset value of the tension has only to be made higher by a value not lower than 4F when the wrapper rolls 19 are brought into contact with the coil.

Next, a strip coiling method in accordance with a fifth embodiment of the present invention will be described with reference to FIGS. 11 to 15. Although this embodiment can be applied to the above-described first and second embodiments, a case where this embodiment is applied in place of pressing force setting by using the compensation pressing force setter 124 in the first embodiment is described by way of example. In this embodiment, therefore, the same reference numerals are applied to the same elements in FIG. 1, and the duplicated explanation of the first embodiment is omitted.

If the pressing force applied to the strip by the upper pinch roll 105*b* is improper when the offset angle of the upstream coiling pinch rolls 105 is changed, for a thin strip, the tail end of the preceding strip $S_1$ coiled by the downstream coiler 104 cannot be held sufficiently between the upstream coiling pinch rolls 105. Therefore, the tail end of the preceding strip $S_1$ comes off from the upstream coiling pinch rolls 105 and is oversupplied, and hits the triangular gate 128, so that breakage of tail end may occur. For a thick strip, in some cases, the following strip $S_2$ cannot be introduced to the upstream coiler 101 correctly.

Also, in the case where a strip having relatively long time from when the preceding strip $S_1$ goes through the coiling pinch rolls 105 after the cutting operation to when the following strip $S_2$ is bitten by the coiling pinch rolls 105, if the pressing force of the coiling pinch rolls 105 is being controlled, the pressing load is made zero by the sheet coming-off of the preceding strip $S_1$. Therefore, a gap of the coiling pinch rolls 105 operates in the closing direction, so that there is a danger of occurring defective biting of the following strip $S_2$.

In this embodiment, therefore, in order to prevent breakage of the tail end of strip and to make the bending direction of the following strip optimum, a proper pressing force on the delivery side of the strip shear is set. Also, in this embodiment, the leading end of the following strip is prevented from being improperly bitten by the coiling pinch rolls.

The following will be a detailed description.

FIG. 14 shows a state in which the lower pinch roll 105*a* is retracted to the upstream side by an offset amount of ΔL with respect to the upper pinch roll 105*b*. FIG. 15 shows a state in which after the lower pinch roll 105*a* is offset, the upper pinch roll 105*b* is pressed down with a pressing force P.

A product P·Δx of the pressing force P of the pinch rolls 105 times a vertical displacement Δx of the pinch roll 105 caused by the pressing force P means work done by the pressing force P.

If a pressing force applied by the upper pinch roll 105*b* when the upper pinch roll 105*b* is located at position x is taken as P(x), the work done when the upper pinch roll 105*b* is pressed down from a position of x=0 to a position of x=Δx is expressed by the following equation (22).

$$\int_0^{\Delta x} P(x)\cdot dx \tag{22}$$

On the other hand, if the upper pinch roll 105*b* presses down the strip by Δx, the strip is displaced in the direction in which the tension is given as shown in FIG. 15. If the displacement at this time is taken as Δu, the work necessary to displace the strip by Δu against the tension F is F·Δu.

Also, in order to press down the strip to the state shown in FIG. 15 by the upper pinch roll 105*b*, bending deformation is applied to the strip along the outer peripheral surface of the lower pinch roll 105*a* on the entrance side of the pinch rolls 105, and re-bending deformation along the lower pinch roll 105*a* by the bending deformation and re-bending deformation along the outer peripheral surface of the upper pinch roll 105*b* by the bending deformation are applied on the delivery side of the pinch rolls 105.

The bending work done when a bend of a bending length l is created with a radius of curvature R by a bending moment $M_B$ produced on the strip is expressed as $M_B\cdot(l/R)$. Taking the radiuses of the lower pinch roll 105*a* and the upper pinch roll 105*b* as $R_L$ and $R_U$, respectively, and the length along the roll of a portion of the lower pinch roll 105*a* around which the strip is bent and the length along the roll of a portion of the upper pinch roll 105*b* around which the strip is bent as $l_a$ and $l_b$ respectively, the work for effecting bending deformation of the strip along the outer peripheral surface of the lower pinch roll 105*a* is expressed as $M_B\cdot(l_a/R_L)$, and the re-bending deformation along the lower pinch roll 105*a* by the bending deformation on the delivery side of the pinch rolls 105, the bending deformation of strip along the outer peripheral surface of the upper pinch roll 105*b*, and the work for effecting the re-bending deformation along the outer peripheral surface of the upper pinch roll 105*b* by the bending deformation are expressed as $M_B\cdot(l_a/R_L)$, $M_B\cdot(l_b/R_U)$, and $M_B\cdot(l_b/R_U)$, respectively.

Therefore, the sum of work necessary for the bending and re-bending deformation effected on the entrance and delivery sides of the pinch rolls 105 is $2M_B\{(l_a/R_L)+(l_b/R_U)\}$.

A value obtained by deducting the work for displacing the strip by Δu in the direction of the tension F from the work necessary for moving the upper pinch roll 105*b* from the position of x=0 to the position of x=Δx is balanced with the work necessary for effecting the bending and re-bending deformation of the strip, so that the following equation (23) holds.

$$\int_0^{\Delta x} P(x)\cdot dx - F\cdot\Delta u = 2M_B\{(l_a/R_L)+(l_b/R_U)\} \tag{23}$$

Here, $M_B$ can be expressed by the following equation (24).

$$M_B=(1/6)\sigma_B\cdot t^2\cdot w \tag{24}$$

where $\sigma_B$ is the yield stress of strip, t is the thickness of strip, and w is the width of strip.

Figure 11:
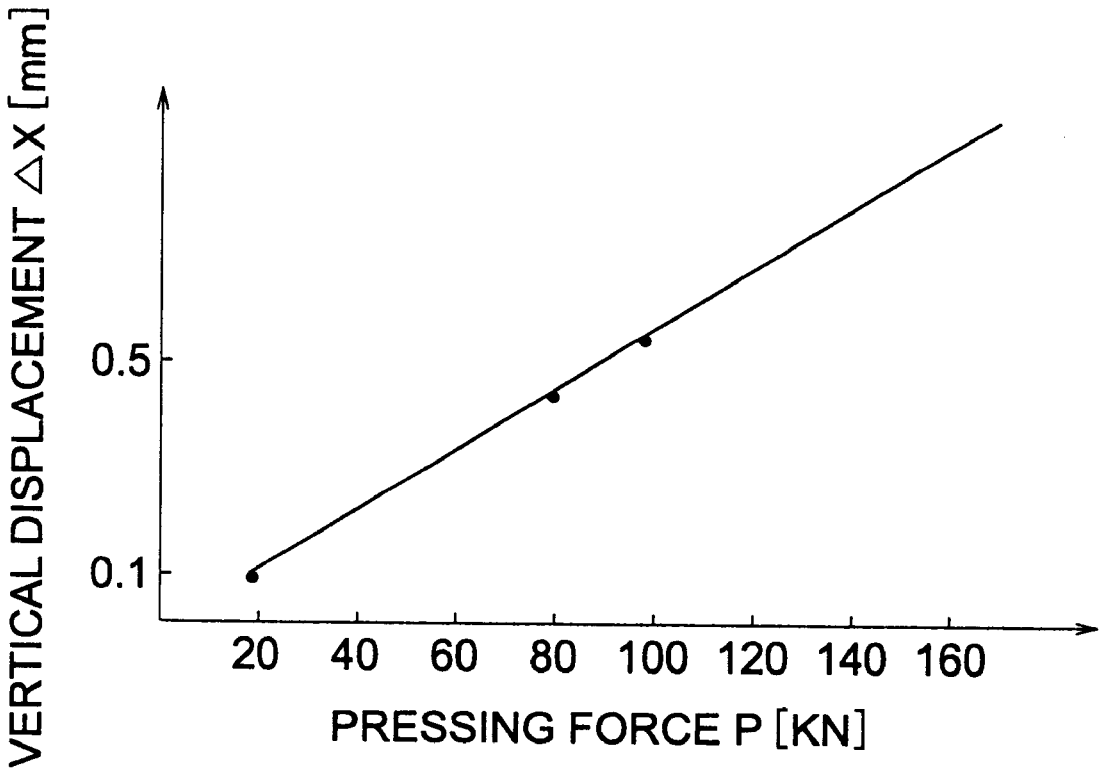
FIG. 11 is a graph showing a relationship between the pressing force and pressing amount on a strip caused by an upper pinch roll of the coiling pinch rolls, the view being used for illustrating a fifth embodiment of the present invention.

The inventors have verified that if the upper pinch roll 105*b* is pressed down further from the state in which the upper pinch roll 105*b* begins to come into contact with the strip, the load necessary for pressing down the upper pinch roll 105*b* increases linearly as the upper pinch roll 105*b* is pressed down during the time when the strip is deformed elastically. FIG. 11 shows the relationship between the pressing force of the upper pinch roll and the displacement in the downward direction of the upper pinch roll. For this relationship, the inclination is determined according to the size of pinch roll, the material and size of strip, or the like. Therefore, if P(x) is assumed to be a linear function such that P(0)=0 and $P(\Delta x)=P_0$, P(x) is expressed as $P(x)=P_0 \cdot x/\Delta x$. Therefore, Equation (23) is expressed by the following equation (25), and the following equation (26) holds from Equations (25) and (24).

$$\frac{1}{2} \cdot P_0 \cdot \Delta x - F \cdot \Delta u = 2M_B\{(l_a / R_L) + (l_b + R_U)\} \tag{25}$$

$$P_0 = F \cdot \frac{2\Delta u}{\Delta x} + \frac{4}{\Delta x}\left(\frac{l_a}{R_L} + \frac{l_b}{R_U}\right) \cdot \frac{1}{6} \cdot \sigma_B \cdot t^2 \cdot w \tag{26}$$

where $P_0$: pressing force of pinch roll

F: tension of strip

Δu: displacement of strip caused by the tension F

Δx: vertical displacement of pinch roll caused by the pressing force P $M_B$: bending moment created on strip=$(1/6)\sigma_B \cdot t^2 \cdot w$ $\sigma_B$: yield stress of strip t: thickness of strip w: width of strip $l_a$: length along the roll of a portion of lower pinch roll around which the strip is coiled $R_L$: radius of pinch roll $l_b$: length along the roll of a portion of upper pinch roll around which the strip is coiled $R_U$: radius of upper pinch roll The displacement Δx and Δu can be calculated geometrically. The yield stress $\sigma_B$ of the strip is a value determined according to material, and the thickness t and the width w of the strip is determined according to the treated material. Therefore, if the tension F of the strip is determined from the rotational speed of the coiler and the rotational speed of the pinch rolls, the optimum pressing force P can be calculated. In this embodiment, the pressing force of the coiling pinch roll is set at a value not lower than $P_0$ determined by the above-described equation (26).

Figure 12:
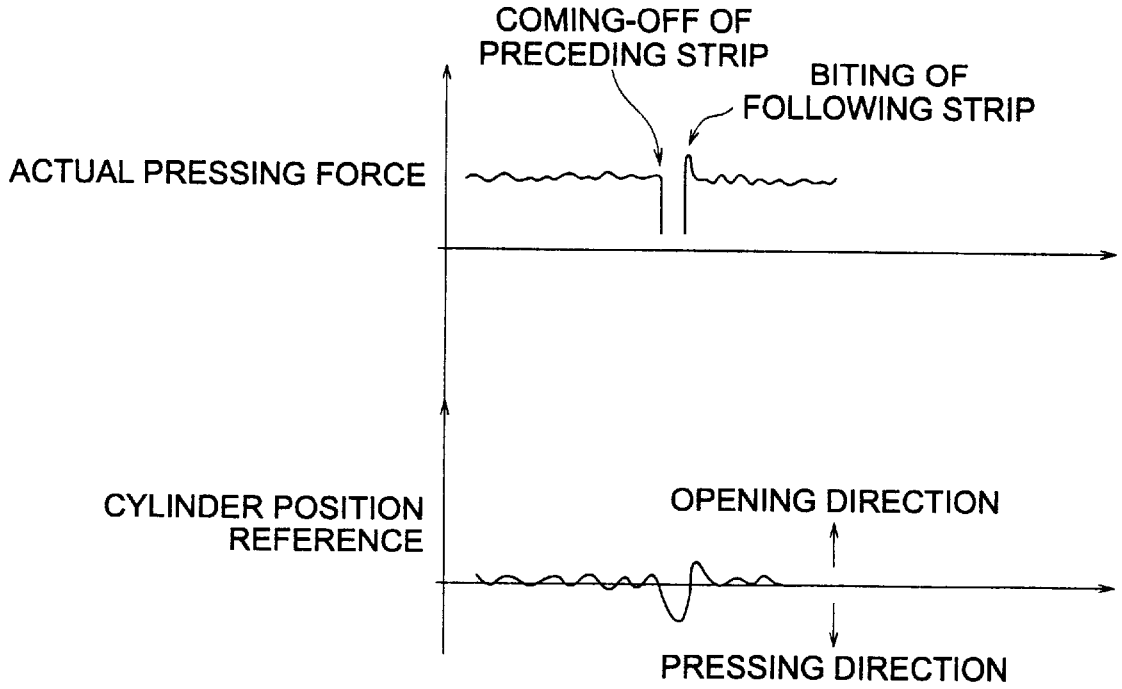
FIG. 12 is a time chart of the pressing force on a strip caused by the upper pinch roll of the coiling pinch rolls and a cylinder position reference.

FIGS. 12 and 13 are charts showing the actual pressing force and the cylinder position reference for pressing down the pinch roll. FIG. 12 shows a case where the pressing force setting in this embodiment is not performed, and FIG. 13 shows this embodiment. The pressing force suddenly decreases to a no-load condition when the preceding strip comes off from the pinch rolls. If the pressing force decreases, as shown in FIG. 12, the cylinder position reference acts in the direction such that the pressing force is kept to operate the pinch roll in the pressing direction. Therefore, there is the possibility of occurring defective biting of the following strip. Even if defective biting does not occur, when the following strip is bitten by the pinch rolls, the pressing force increases suddenly and then is restored to the preset value, and the cylinder position reference changes rapidly so that the pinch rolls are operated in the opening direction, so that overaction causes hunting.

Contrarily, in FIG. 13, the servo valve is locked so that the cap of pinch roll is kept constant until the preceding strip comes off from the pinch rolls and the following strip is bitten by the pinch rolls after the pressing force is set, by which the cylinder position is held, so that the cylinder position reference is kept constant. Therefore, there is no possibility of occurring defective biting of the following strip.

Industrial Applicability

As is apparent from the above description, according to the present invention, an effect can be achieved that the preceding strip can be prevented from being oversupplied on the delivery side of the coiling pinch rolls, and also the leading end of the following material can be prevented from being oversupplied on the entrance side of the coiling pinch rolls.

Also, in the case where the present invention is applied to a hot rolling line provided with a Carrousel reel type coiler, the relationship between the preset coiling speed $V_m$ of the mandrel after the tail end of the strip coiled by the mandrel via the coiling pinch rolls, the target speed $V_p$ of the coiling pinch rolls at the time of the cutting operation, and the sheet speed $V_s$ of the following material immediately after the cutting operation is set so that $V_m>V_p>V_s$. Thereby, an effect can be achieved that the preceding strip can be prevented from being caught by the tip end of the sheet-running guide located at a position where the pass line directed to the mandrel at the coiling start position branches off the pass line directed to the mandrel at the coiling finish position.

Further, in the case where the present invention is applied to a general hot rolling line, the relationship between the target speed $V_{p1}$ of the second coiling pinch rolls when the tail end of the strip coiled by the downstream mandrel via the second coiling pinch rolls disposed on the entrance side of the downstream mandrel is cut, the target speed $V_{p2}$ of the first coiling pinch rolls disposed on the delivery side of the strip shear, the target sheet speed $V_s$ of the following material immediately after the cutting operation, and the preset coiling speed $V_m$ of the downstream mandrel is set so that $V_m>V_{p1}>V_{p2}>V_s$. Thereby, an effect can be achieved that damage to the strip caused by the tail end of the preceding strip being caught by the triangular gate can be prevented.

In this case, after the lower pinch roll of the first coiling pinch rolls is offset and before the tail end of the strip coiled by the downstream mandrel via the second pinch rolls is cut, the strip is pressed by the upper pinch roll of the first coiling pinch rolls in the state in which the speed of the lower pinch roll is made lower than the target sheet speed $V_s$ of the following material until the actual torque value of the lower pinch roll becomes the preset value, and the pressing force at this time is made the preset pressing force of the offset upper pinch roll applied to the strip, by which the tail end of the strip coiled by the downstream mandrel can be held properly by the first coiling pinch rolls. Therefore, an effect can be achieved that the slip of the strip tail end with respect to the upstream coiling pinch rolls can surely be eliminated.

Also, before the strip cut by the strip shear is continuously coiled by the mandrel via the coiling pinch rolls disposed on the delivery side of the strip shear, the pressing force of the coiling pinch rolls is set at a value not lower than a value P determined by $P=F(\Delta u/\Delta x)+2(M_B/\Delta x)\{(l_a/r)+(l_b/R)\}$. Thereby, the pressing force of the upper pinch roll can be set at the optimum value. Therefore, an effect can be achieved that the breakage of tail end of a thin strip, improper introduction of a thick strip to the coiler, and other troubles can be prevented.

In this case, after the pressing force is set, by keeping the gap of the coiling pinch rolls for the time from when the preceding strip comes off from the pinch rolls to when the following strip is bitten by the pinch rolls, an effect can be achieved that the defective biting of the following strip by the coiling pinch rolls and other troubles can be prevented.

Further, before the strip coiling operation performed by the mandrel is finished, the strip coiling control carried out by the mandrel is changed over from torque control to rotational speed control, and thereafter the pressing roll is pressed on the strip to be coiled into a coil shape to stop the rotation of the mandrel. Alternatively, before the strip coiling operation performed by the mandrel is finished, the torque control of strip is carried out by the mandrel to increase the tension of strip, and thereafter the pressing roll is pressed on the strip to be coiled into a coil shape to stop the rotation of the mandrel. Thereby, effects can be achieved that the decrease in speed of coil caused by the contact of the pressing roll can be prevented, the occurrence of defective coiling such as loosened coil outer and telescoping can be avoided, and the rotation of coil can be stopped in a short time because the pressing roll has a braking force when the rotation of coil is stopped after the strip coiling operation is finished.

Further, the deceleration-side torque limit of the driving unit for the coiling pinch rolls is set so that the circumferential speed of the coiling pinch rolls is higher than the transfer speed of the following material when the leading end of the following material is bitten by the coiling pinch rolls disposed on the delivery side of the strip shear after the strip is cut by the strip shear. Thereby, an effect can be achieved that even in the case of a strip having a great sheet thickness and high bending rigidity, the following material can be prevented from being oversupplied on the entrance side of the coiling pinch rolls.

What is claimed is:

1. A strip coiling method in which a strip sent from a rolling mill is cut to a predetermined length by a strip shear, and a cut strip is coiled by a mandrel of a coiler via coiling pinch rolls disposed on the delivery side of said strip shear, characterized in that after a tail end of the strip coiled by said mandrel via said coiling pinch rolls is cut by said strip shear, a circumferential speed of said coiling pinch rolls is higher than a transfer speed of the following material immediately after a cutting operation and lower than a coiling speed of the strip coiled by said mandrel.

2. The strip coiling method according to claim 1, characterized in that said mandrel is a mandrel of a carrousel reel type coiler, and the relationship between a preset coiling speed $V_m$ of said mandrel after the tail end of the strip coiled by said mandrel via said coiling pinch rolls, the target speed $V_p$ of said coiling pinch rolls at the time of the cutting operation, and the sheet speed $V_s$ of the following material immediately after the cutting operation is set so that $V_s>V_p>V_s$.

3. The strip coiling method according to any one of claim 1, characterized in that before the strip cut by said strip shear is continuously coiled by said mandrel via said coiling pinch rolls disposed on the delivery side of said strip shear, the pressing force of said coiling pinch rolls is set at a value not lower than a value P determined by the following equations:

$$P=2F(\Delta u/\Delta x)+4(M_B/\Delta x)\{(1_a/R_L)+(1_b/R_U)\}$$

where,

P: pressing force of pinch roll

F: tension of strip

Δu: displacement of strip caused by the tension F

Δx: vertical displacement of pinch roll caused by the pressing force P $M_B$: bending moment created on strip=$(1/6)\sigma_B \cdot t^2 \cdot w$ $\sigma_B$: yield stress of strip t: thickness of strip w: width of strip $l_a$: length along the roll of a portion of lower pinch roll around which the strip is bent $R_L$: radius of lower pinch roll $l_b$: length along the roll of a portion of upper pinch roll around which the strip is bent $R_U$: radius of upper pinch roll.

4. The strip coiling method according to claim 3, characterized in that after said pressing force is set, a gap of said coiling pinch rolls is kept for the time from when the preceding strip comes off from said pinch rolls to when the following strip is bitten by said pinch rolls.

5. The strip coiling method according to claim 1, characterized in that the speed ratio of said mandrel to said coiling pinch rolls in the acceleration process is set in relation to the ratio of final speed of said mandrel to said coiling pinch rolls.

6. The strip coiling method according to claim 1, characterized in that before the strip coiling operation performed by said mandrel is finished, the strip coiling control carried out by said mandrel is changed over from torque control to rotational speed control, and thereafter a pressing roll is pressed on the strip to be coiled into a coil shape to stop the rotation of said mandrel.

7. The strip coiling method according to claim 1, characterized in that before the strip coiling operation performed by said mandrel is finished, the torque control of strip is carried out by said mandrel to increase the tension of strip, and thereafter a pressing roll is pressed on the strip to be coiled into a coil shape to stop the rotation of said mandrel.

8. The strip coiling method according to claims 1, characterized in that a deceleration-side torque limit of a driving unit for said coiling pinch rolls is set so that the circumferential speed of said coiling pinch rolls is higher than the transfer speed of said following material when the leading end of said following material is bitten by said coiling pinch rolls disposed on the delivery side of said strip shear after the strip is cut by said strip shear.

9. A strip coiling method in which a strip sent from a rolling mill is cut to a predetermined length by a strip shear, and a cut strip is coiled alternately by a mandrel of an upstream coiler and a mandrel of a downstream coiler via first coiling pinch rolls disposed on the delivery side of said strip shear, characterized in that the relationship between the target speed $V_{p1}$ of said second coiling pinch rolls after the tail end of the strip coiled by a downstream mandrel via second coiling pinch rolls disposed on the entrance side of said downstream mandrel is cut by said strip shear, the target speed $V_{p2}$ of said first coiling pinch rolls, the target sheet speed $V_s$ of the following material immediately after the cutting operation, and the preset coiling speed $V_m$ of said downstream mandrel is set so that $V_m>V_{p1}>V_{p2}>V_s$.

10. The strip coiling method according to claim 9, characterized in that after a lower pinch roll of said first coiling pinch rolls is offset and before the tail end of the strip coiled by said downstream mandrel via said second pinch rolls is cut, the strip is pressed by an upper pinch roll of said first coiling pinch rolls in a state in which the speed of said first lower pinch roll is made lower than the target sheet speed $V_s$ of the following material until the actual torque value of said first lower pinch roll becomes the preset value, and the pressing force at this time is made the preset pressing force of said offset upper pinch roll applied to the strip.

11. The strip coiling method according to claim 9, characterized in that the speed ratio of said downstream coiler to said second coiling pinch rolls in the acceleration process is set in relation to the ratio of target speed of said downstream coiler to said second coiling pinch rolls, and the speed ratio of said second coiling pinch rolls to said first coiling pinch rolls in the acceleration process is set in relation to the ratio of target speed of said second coiling pinch rolls to said first coiling pinch rolls.

* * * * *